US006735405B2

(12) United States Patent
Yokoi et al.

(10) Patent No.: US 6,735,405 B2
(45) Date of Patent: May 11, 2004

(54) METHOD OF REMANUFACTURING PROCESS CARTRIDGE AND DEVELOPING DEVICE

(75) Inventors: Akiyoshi Yokoi, Shizuoka (JP); Toru Oguma, Shizuoka (JP); Ken Kikuchi, Shizuoka (JP); Ryuta Murakami, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/307,925

(22) Filed: Dec. 3, 2002

(65) Prior Publication Data

US 2003/0108358 A1 Jun. 12, 2003

(30) Foreign Application Priority Data

Dec. 7, 2001 (JP) ..... 2001-374207
Dec. 26, 2001 (JP) ..... 2001-394033
Nov. 26, 2002 (JP) ..... 2002-342057

(51) Int. Cl.[7] ..... G03G 15/00; G03G 15/08
(52) U.S. Cl. ..... 399/109; 399/106
(58) Field of Search ..... 399/27, 102, 103, 399/105, 106, 109, 111, 113, 119

(56) References Cited

U.S. PATENT DOCUMENTS 4,862,210 A * 8/1989 Woolley ..... 399/106
5,455,665 A 10/1995 Baba, et al.
5,870,654 A * 2/1999 Sato et al. ..... 399/109
6,240,605 B1 * 6/2001 Stevens et al. ..... 399/106 X
6,253,036 B1 6/2001 Karakama, et al. ..... 399/27
6,272,299 B1 8/2001 Numagami, et al. ..... 399/111
6,289,188 B1 * 9/2001 Litman et al. ..... 399/109
6,377,759 B1 4/2002 Abe, et al. ..... 399/27
2001/0017990 A1 8/2001 Oguma, et al. ..... 399/27
2001/0036373 A1 * 11/2001 Higeta et al. ..... 399/109
2001/0038758 A1 11/2001 Oguma, et al. ..... 399/27
2002/0025174 A1 2/2002 Sakurai, et al. ..... 399/13
2002/0025177 A1 2/2002 Yokoi, et al. ..... 399/27
2002/0064930 A1 5/2002 Ishikawa ..... 438/612
2002/0067930 A1 6/2002 Oguma, et al. ..... 399/222
2002/0122674 A1 9/2002 Yokoi, et al ..... 399/113

FOREIGN PATENT DOCUMENTS

JP 2001-249603 * 9/2001
JP 2001-312198 * 11/2001

* cited by examiner

*Primary Examiner*—Sandra Brase
(74) *Attorney, Agent, or Firm*—Fitzpatrick, Cella, Harper & Scinto

(57) ABSTRACT

A method of remanufacturing a process cartridge includes a step of removing a pin to thereby separate a drum unit and a developing container, a step of separating a developing frame and a developer frame from each other to thereby separate the developing container, a step of resupplying the developer to a developer containing portion of the developer frame, a step of superposing a reseal member on end portion seal members provided at lengthwise one end and other end of a developer supply opening for supplying the developer contained in a developer containing portion to a developing roller, and interposing the reseal member on each of widthwise one end and other end of the developer supply opening along the lengthwise direction of the developer supply opening, and reuniting the developing frame and the developer frame, and a step of reuniting the reconstructed developing container and the drum unit.

30 Claims, 21 Drawing Sheets

METHOD OF REMANUFACTURING PROCESS CARTRIDGE AND DEVELOPING DEVICE

BACKGROUND OF THE INVENTION

1. Field of the Invention

The invention relates to a method of remanufacturing a process cartridge detachably mountable to the main body of an electrophotographic image forming apparatus and a developing device.

Here, the electrophotographic image forming apparatus forms an image on a recording medium by the use of the electrophotographic image forming process. Examples of the electrophotographic image forming apparatus include an electrophotographic copying machine, an electrophotographic printer (such as a laser printer or an LED printer), a facsimile apparatus and a word processor.

Also, the process cartridge refers to charging means, developing means or cleaning means as process means and an electrophotographic photosensitive member integrally made into a cartridge, which is made detachably mountable to the main body of the electrophotographic image forming apparatus. It also refers to at least one of charging means, developing means and cleaning means as process means and an electrophotographic photosensitive member integrally made into a cartridge, which is made detachably mountable to the main body of the electrophotographic image forming apparatus. It further refers to at least developing means as process means and an electrophotographic photosensitive member integrally made into a cartridge, which is made detachably mountable to the main body of the electrophotographic image forming apparatus. Also, the developing device refers to developing means and a developer containing portion integrally made into a cartridge which is made detachably mountable to the main body of the electrophotographic image forming apparatus.

2. Description of Related Art

In image forming apparatuses using the electrophotographic image forming process, there has heretofore been adopted a process cartridge system in which an electrophotographic photosensitive member and process means for acting on the electrophotographic photosensitive member are integrally made into a cartridge which is made detachably mountable to the main body of the electrophotographic image forming apparatus. According to this process cartridge system, the maintenance of the electrophotographic image forming apparatus can be done by a user himself without resort to a serviceman and therefore, operability can be markedly improved. So, this process cartridge system is widely used in the electrophotographic image forming apparatuses.

Also, in the electrophotographic image forming apparatuses of such a process cartridge type, the user himself must interchange the cartridge. Therefore, some of the electrophotographic image forming apparatuses are provided with developer amount detecting means to inform the user when a developer has been consumed. As the developer amount detecting means, there is a method of detecting any change in the capacitance among a plurality of electrodes disposed in the process cartridge to thereby detect the amount of developer.

As the constructions of these electrodes, there are a construction in which electrode bars are disposed at predetermined intervals from a developing roller (the capacitance between the developing roller and the electrode bars is detected), a construction in which a plurality of opposed electrode plates are disposed at a location the developer can enter, and a combination of these.

There is also a construction in which the connecting portion of these electrodes is disposed in the ultrasonic welding united portion between a developing container and a developer container to thereby improve the reliability of the contact.

There has heretofore been desired a simple method of remanufacturing a process cartridge and a developing device which have lost their commercial values with a developer therein consumed and capable of commercializing them again.

SUMMARY OF THE INVENTION

It is an object of the present invention to provide a method of remanufacturing a process cartridge or a developing device having the above-described construction.

It is another object of the present invention to provide a remanufacturing method in which the maintenance of the sealability of a developer when a developing container and a developer container that are separated from each other are reunited and the remanufacturability are compatible.

It is another object of the present invention to provide a method of remanufacturing a process cartridge and a developing device from which a developer does not leak in spite of their having been remanufactured.

It is another object of the present invention to provide a simple method of remanufacturing a process cartridge and a developing device.

It is another object of the present invention to provide a method of remanufacturing a process cartridge and a developing device which can again commercialize a process cartridge and a developing device that have lost their commercial value as a process cartridge and a developing device with a developer therein consumed to such a degree that they cannot form an image of a quality with which the user will be satisfied.

It is another object of the present invention to provide a process cartridge and a developing device which can seal two frames having their united surfaces disassembled without the leakage of a toner.

It is another object of the present invention to provide a method of remanufacturing a process cartridge and a developing device which can improve the reliability of an electrical contact and can easily remanufacture a process cartridge and a developing device.

There and other objects, features and advantages of the present invention will become more apparent upon consideration of the following description of the preferred embodiments of the present invention taken in conjunction with the accompanying drawings.

DETAILED DESCRIPTION OF THE PREFERRED EMBODIMENTS

Some embodiments of the present invention will hereinafter be described with reference to the drawings.

(First Embodiment)

[Electrophotographic Image Forming Apparatus A and Process Cartridge B]

Figure 1:
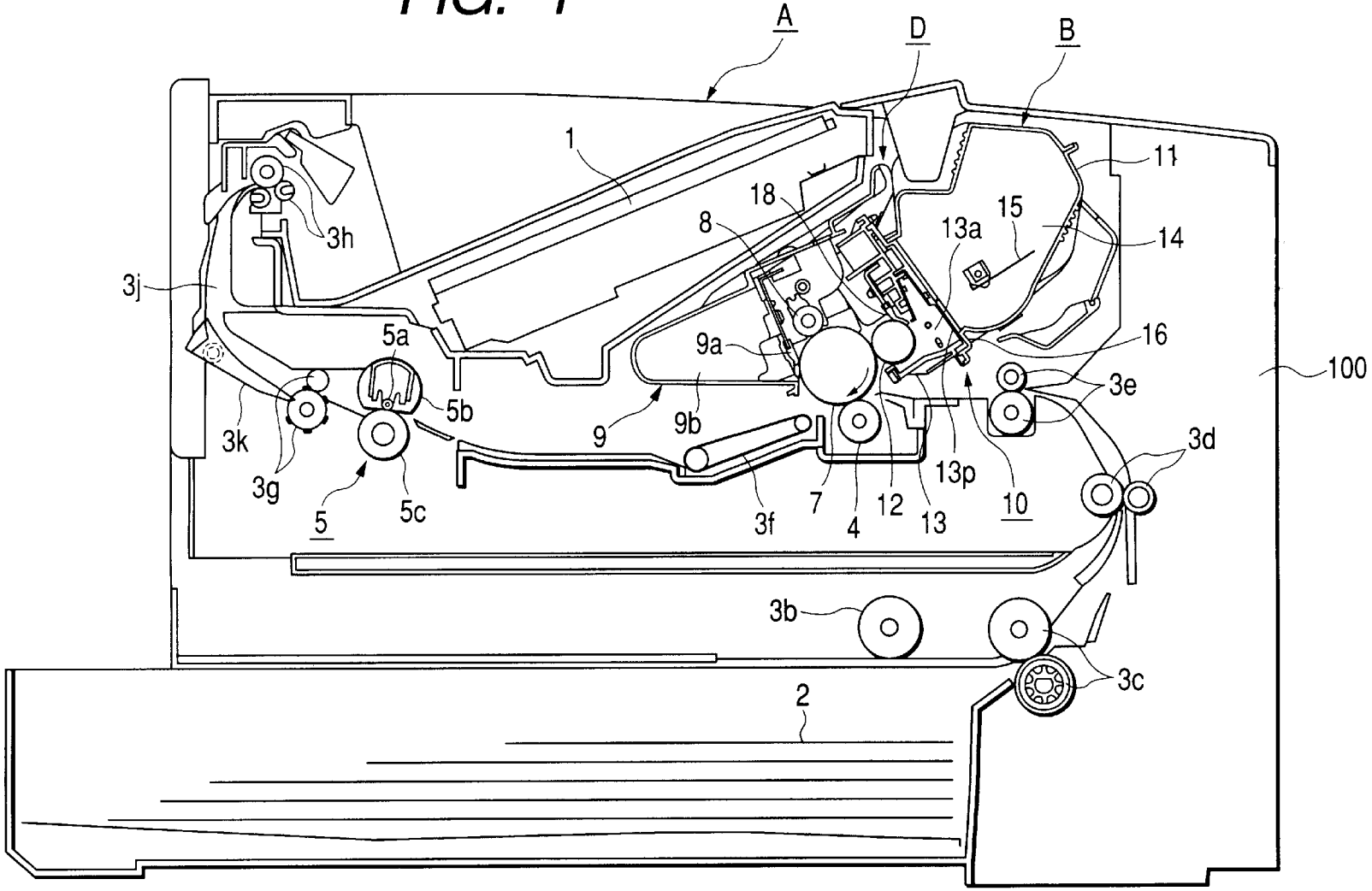
FIG. 1 schematically shows the construction of an electrophotographic image forming apparatus according to an embodiment of the present invention.
Figure 2:
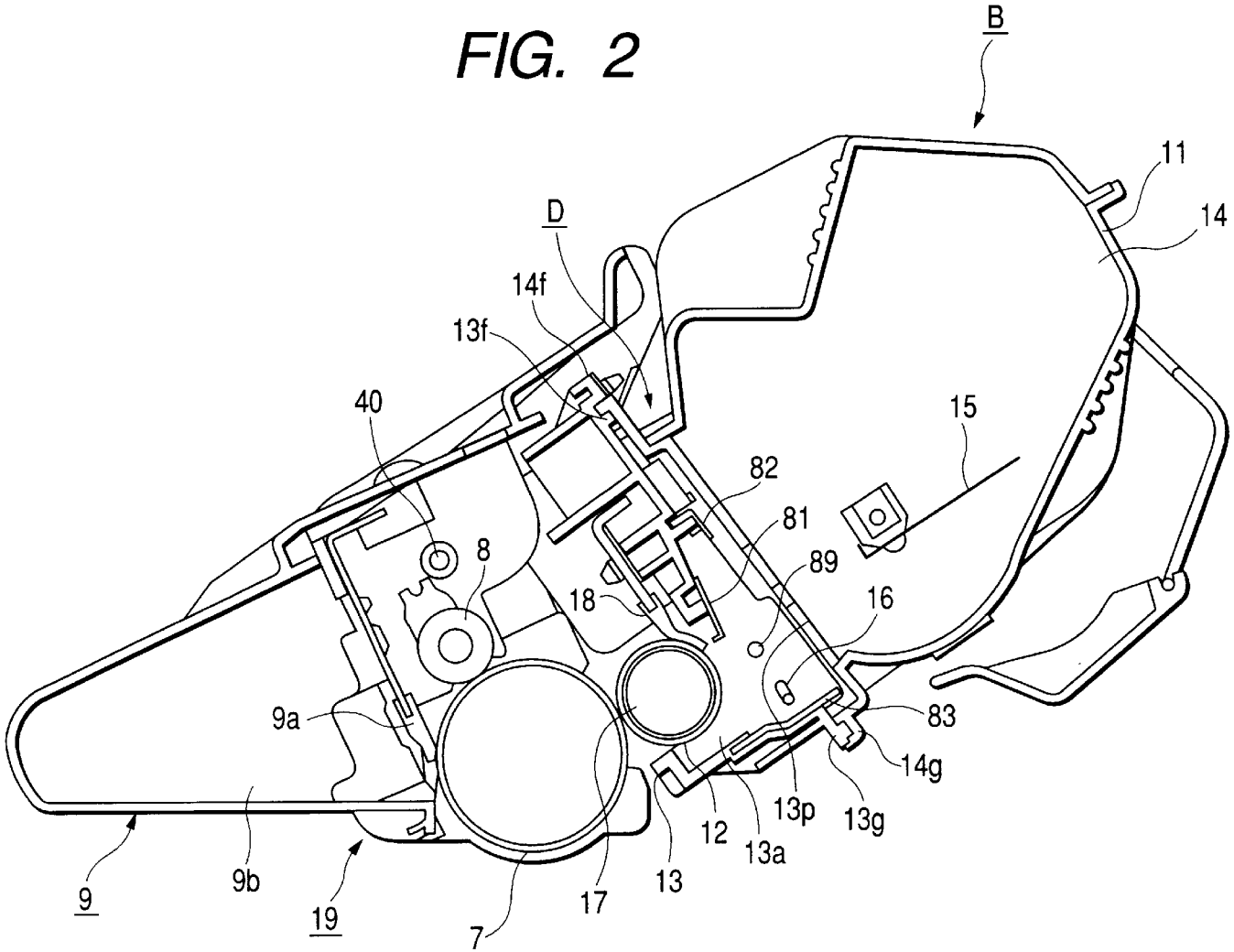
FIG. 2 is a cross-sectional view of a process cartridge according to the present embodiment.

A description will first be provided of an embodiment of an image forming apparatus to which a process cartridge is detachably mountable. FIG. 1 is a cross-sectional view of an electrophotographic image forming apparatus A according to the present embodiment. FIG. 2 is a cross-sectional view of a process cartridge B.

The image forming apparatus A has a drum-shaped electrophotographic photosensitive member, i.e., an electrophotographic photosensitive drum 7. The photosensitive drum 7 is charged by a charging roller 8 which is charging means, and then is irradiated with a laser beam conforming to image information from optical means 1 having a laser diode, a polygon mirror, a lens and a reflecting mirror, whereby a latent image conforming to the image information is formed on the photosensitive drum 7. This latent image is developed into a visible image, i.e., a toner image, by developing means 10.

The developing means 10 as a developing device is such that a developing frame 13 for holding a developing roller 12 and a toner containing portion (developer containing portion) 14 for containing therein a toner which is a developer are united together to thereby constitute a developing container D.

The developing frame 13 has a developing chamber 13*a*, and the toner in the toner containing portion 14 adjacent to the developing chamber 13*a* is fed to the developing roller 12 in the developing chamber 13*a* by the rotation of a toner feeding member 15. The developing frame 13 is provided with a toner agitating member 16 near the developing roller 12, and circulates the toner in the developing chamber 13*a*. Also, the developing roller 12 contains a stationary magnet 17 therein, and the developing roller 12 is rotated, whereby the toner is carried and is given triboelectrification charges by a developing blade 18 and is made into a toner layer of a predetermined thickness, and is carried to the developing area of the photosensitive drum 7. The toner supplied to this developing area is shifted to the latent image on the photosensitive drum 7 to thereby form a toner image. The developing roller 12 is connected to a developing bias circuit, and usually has applied thereto a developing bias voltage comprising a DC voltage superimposed on an AC voltage.

On the other hand, in synchronism with the formation of the toner image, a recording medium (such as recording paper or an OHP sheet) 2 set in a feed cassette is transported to a transferring position by a pick-up roller 3*b* and pairs of transport rollers 3*c*, 3*d* and 3*e*. A transfer roller 4 as transferring means is disposed at the transferring position, and a voltage is applied thereto to thereby transfer the toner image on the photosensitive drum 7 to the recording medium.

The recording medium 2 to which the toner image has been transferred is transported to fixing means 5 by a transport guide 3*f*. The fixing means 5 is provided with a driving roller 5*c* and a fixing roller 5*b* containing a heater 5*a* therein. It applies heat and pressure to the recording medium 2 passing therethrough and fixes the transferred toner image on the recording medium 2.

The recording medium 2 is transported by pairs of delivery rollers 3*g* and 3*h*, and delivered to a delivery tray via a surface reverse path 3*j*. This delivery tray is provided on the upper surface of the image forming apparatus A. A rockable flapper 3*k* can be operated to deliver the recording medium 2 without the intermediary of the surface reverse path 3*j*. In the present embodiment, transporting means is constituted by the pick-up roller 3*b*, the pairs of transport rollers 3*c*, 3*d*, 3*e*, the transport guide 3*f* and the pairs of delivery rollers 3*g*, 3*h*.

After the toner image has been transferred to the recording medium 2 by the transfer roller 4, any toner residual on the photosensitive drum 7 is removed by cleaning means 9. The photosensitive drum 7 is then used for the next image forming process. The cleaning means 9 scrapes off the residual toner on the photosensitive drum 7 by an elastic cleaning blade 9*a* provided in contact with the photosensitive drum 7 and collects it into a waste toner reservoir 9*b*.

On the other hand, in the present embodiment, the process cartridge B, as shown in FIG. 2, contains the toner therein and is such that the developing frame 13 for supporting developing means such as the developing roller 12 and the developing blade 18 is welded to the toner containing portion 14 having the toner feeding member 15 to thereby integrally constitute a developing container D. Further, the photosensitive drum 7, the cleaning means 9 such as the cleaning blade 9*a* and a drum unit 19 having the charging roller 8 mounted thereon are pivotably united together by a round pin 40. Thereby, the process cartridge B is constituted.

According to the present embodiment, the process cartridge B is provided with first and second toner amount detecting means to detect the remaining amount of toner in accordance with the consumption of the toner in the developing chamber 13*a*.

(First Detecting Means)

In the present embodiment, the first detecting means is such that as shown in FIG. 2, a first electrode 81, a second electrode 82 and a third electrode 83 are measuring electrode members constituting a toner amount detecting portion that are disposed along the developing roller 12. The first electrode 81 and the third electrode 83, as will be described later, are connected together in the developing frame 13 and are at the same potential. The detecting means induces a capacitance among the electrodes by a voltage being applied to the first electrode 81 or the second electrode 82. The capacitance is measured by the main body 100 of the apparatus to thereby detect the amount of toner. In the present embodiment, a voltage is applied to the second electrode 82 (the input side), and the first electrode 81 and the third electrode 83 are the output side.

The first electrode 81, the second electrode 82 and the third electrode 83 are disposed at a location at which the toner transported by the toner feeding member 15 enters. When the amount of toner in the process cartridge B is great, the toner is pushed into a space surrounded by the electrodes by the toner feeding member 15. The capacitance among the electrodes continues to exhibit a high value. As the process cartridge is used, the toner is consumed. In accordance with it, the height of the toner among the electrodes decreases and the capacitance also decreases. Finally the toner near the distal end of the developing blade 18 for scraping off the toner on the surface of the developing roller 12 is consumed, whereby there is brought about a toner-absent state. In the present embodiment, the developing bias voltage applied to the developing roller 12 is an input voltage, and the capacitance between the developing roller 12 and the first electrode 81, is also detected. Thereby, the toner-absent state is detected. That is, the first detecting means can detect any change in the capacitance to thereby detect the amount of toner sequentially.

(Detecting Circuit)

Figure 3:
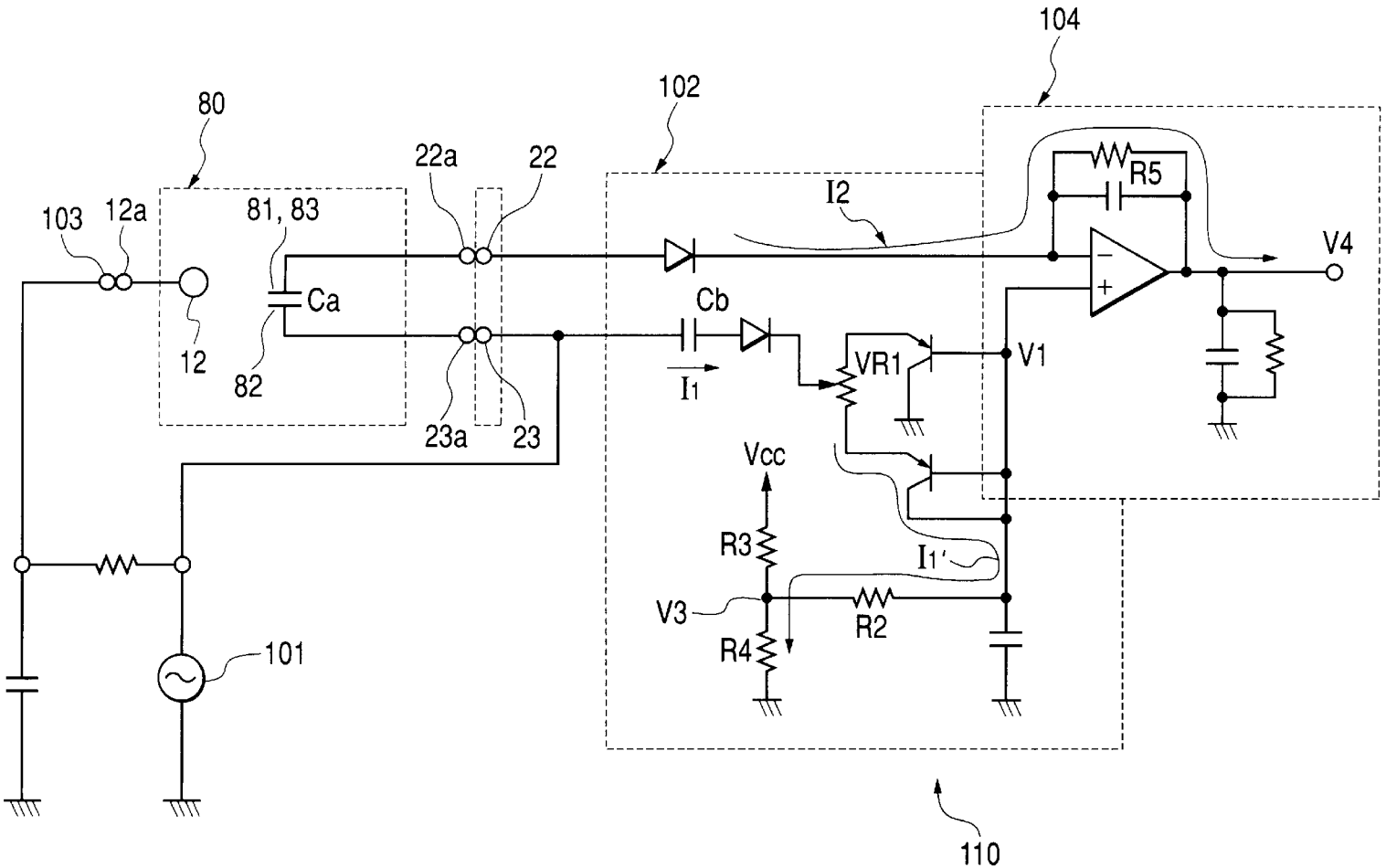
FIG. 3 shows the toner amount detecting circuit of the process cartridge according to the present embodiment.

FIG. 3 shows an example of a toner amount detecting circuit 110 provided in the main body 100 of the image forming apparatus.

A detecting portion 80 having a capacitance Ca fluctuating in conformity with the amount of toner has its one input side electrode as an impedance element, in the present embodiment, the second electrode 82, connected to a developing bias circuit 101 as developing bias applying means through an electrical contact 23. The other output side electrodes, in the present embodiment, the first and third electrodes, are connected to the control circuit 102 of the toner amount detecting circuit 110 through an electrical contact 22. A reference capacitance element Cb is also connected to the developing bias circuit 101. Thereby, a reference voltage V1 in detecting the amount of toner by the use of an AC (alternating current) I1 applied through the developing bias circuit 101 is set. A contact 103 disposed in the main body 100 of the apparatus is electrically connected to the electrical contact 12*a* of the developing roller 12, whereby a developing bias voltage is applied from the developing bias circuit 101 to the developing roller 12.

The control circuit 102 adds an AC I1', which is a value obtained by dividing the AC I1 applied to the reference capacitance element Cb, i.e., a reference impedance element, by a volume control VR1, and a voltage drop amount caused by a resistor R2 to V3 set by resistors R3 and R4, and determines a reference voltage V1.

Accordingly, an AC I2 applied to the toner amount detecting portion 80 is inputted to an amplifying circuit 104, and is outputted as the detected value V4(V1−I2×R5) of the amount of toner. The output value is utilized as the detected value of the remaining amount of toner.

According to the present embodiment, the remaining amount of toner in the process cartridge B is sequentially detected. On the basis of the information, the amount of consumed toner is indicated. Thereby, a user is called upon to prepare a new process cartridge B or a replenishment cartridge. Further, the user can be called upon to interchange the process cartridge B or supply the toner by toner-absence detection information.

(Second Detecting Means)

A second toner amount detecting device will now be described. The second toner amount detecting device, as shown in FIG. 2, is a portion of an antenna rod 89 of an electrically conductive material, e.g. a metal wire, provided along the lengthwise direction of the developing roller 12. The antenna rod 89, if made of an electrically conductive material, is equal in action, but in the present embodiment, a non-magnetic SUS material is used so as not to affect the circulation of the toner. As previously described, the antenna rod 89 is provided over the full length of the developing roller 12 at a predetermined distance from the developing roller 12. The capacitance between the antenna rod 89 and the developing roller 12 is changed by the amount of toner present between the two. So, any change in this capacitance is detected as a change in potential difference by a toner amount detecting contact in the main body 100 of the apparatus to thereby detect the amount of toner. The antenna rod 89, which is the second toner amount detecting device, unlike the aforedescribed first toner amount detecting device, does not sequentially detect the amount of toner, but effects only the detection of the vicinity of toner-absence. The process cartridge B according to the present embodiment is provided with two toner amount detecting devices as described above, whereby it can cope with both of the main body 100 of an image forming apparatus having a mechanism for sequentially detecting the amount of toner and the main body 100 of an image forming apparatus having no sequentially detecting mechanism but effecting only the detection of toner-absence.

Figure 4:
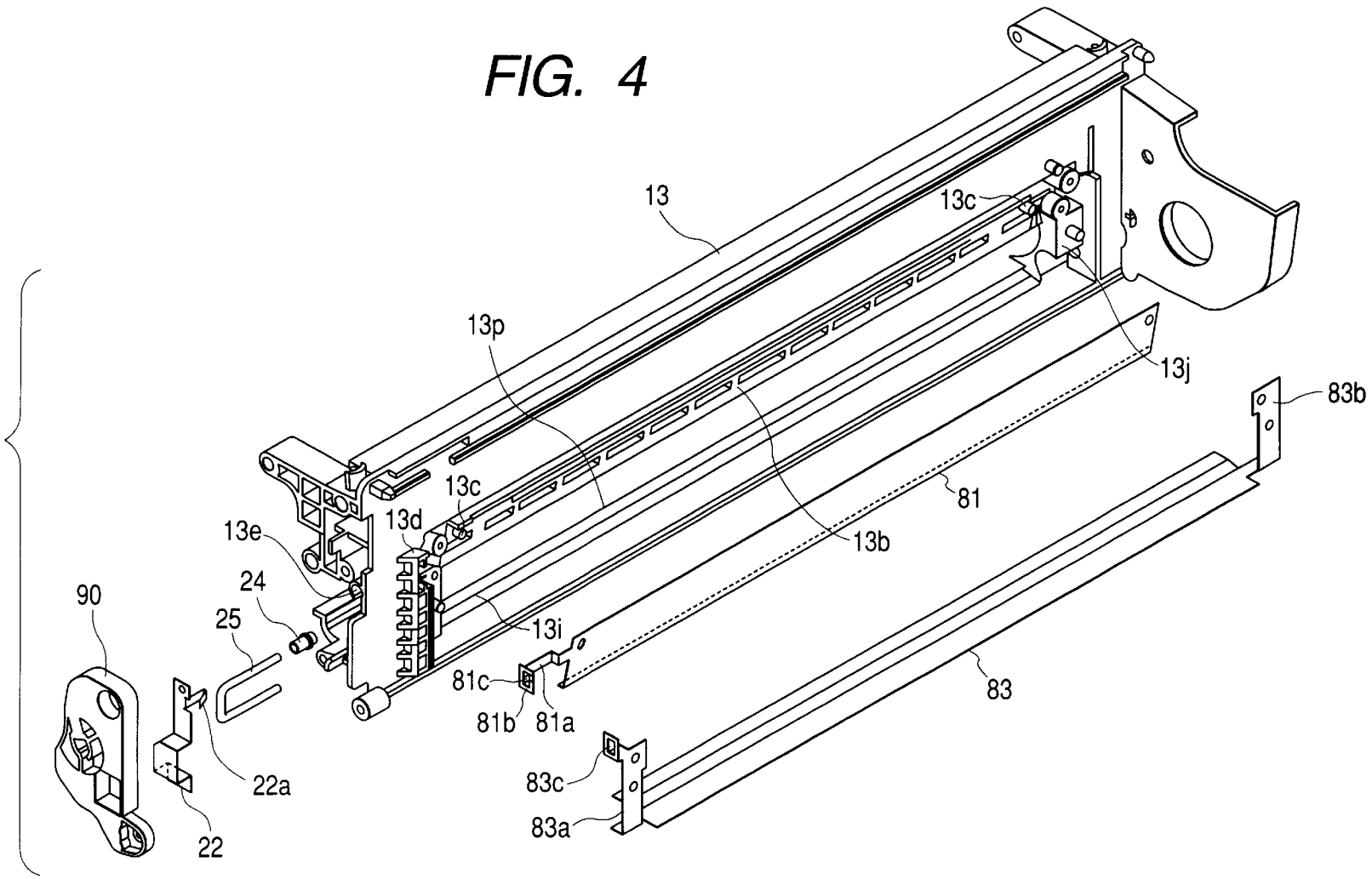
FIG. 4 illustrates the attachment construction of the toner amount detecting electrode of the process cartridge according to the present embodiment.
Figure 5:
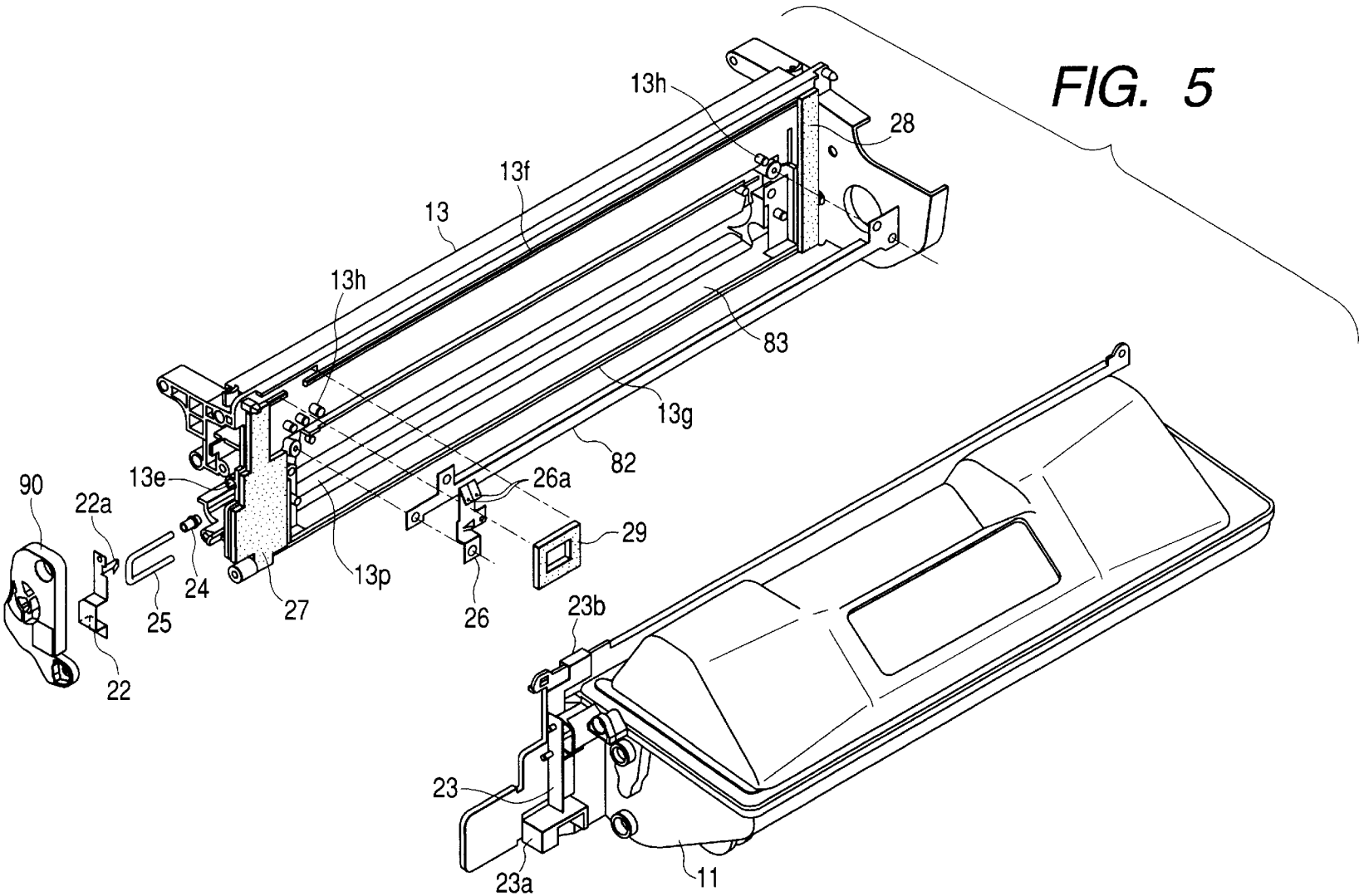
FIG. 5 illustrates the attachment construction of the toner amount detecting electrode of the process cartridge according to the present embodiment.
Figure 8:
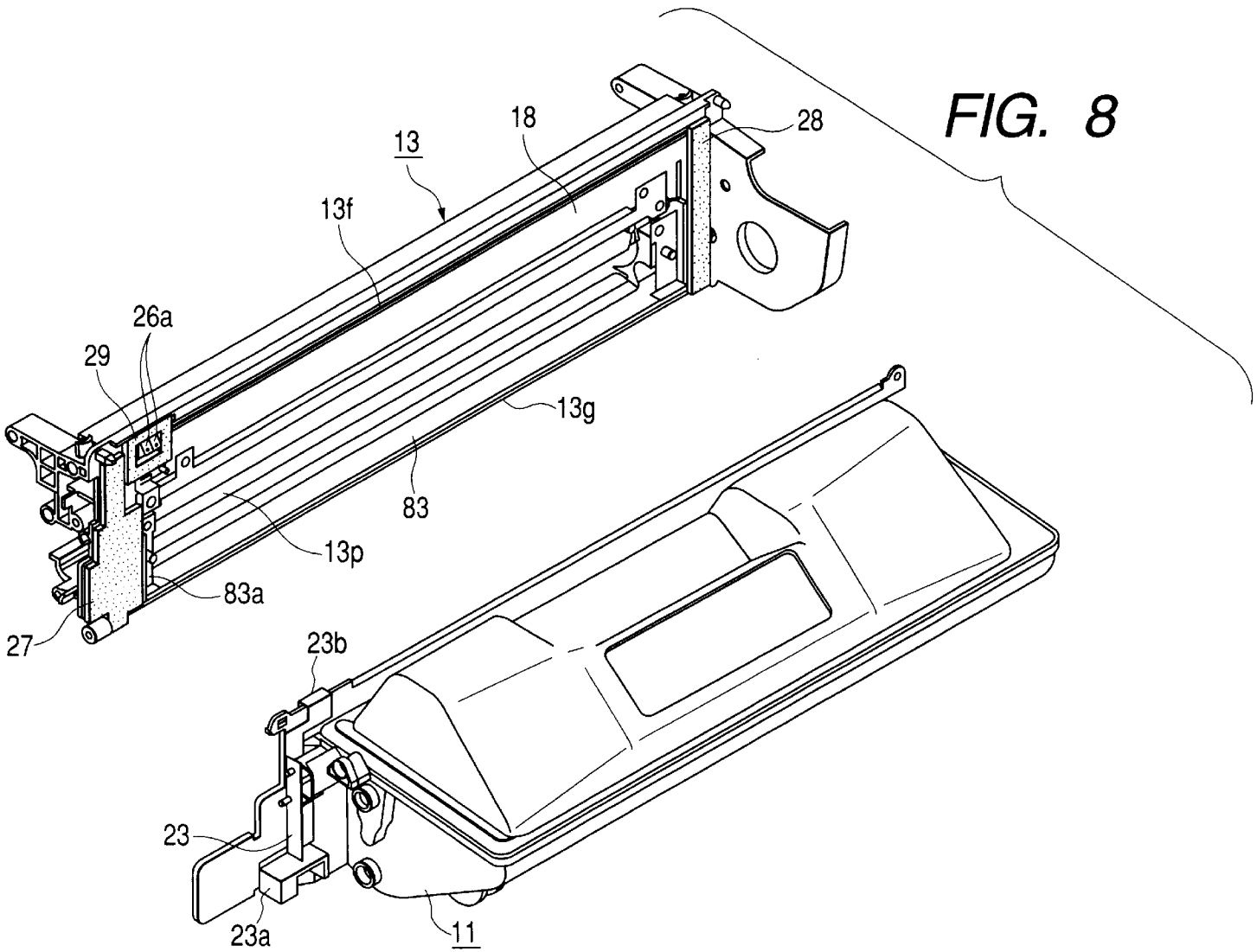
FIG. 8 illustrates the attachment construction of the toner amount detecting electrode of the process cartridge according to the present embodiment.

A description will now be provided of a construction for attaching the first electrode 81, the second electrode 82 and the third electrode 83 of the first toner amount detecting device and the antenna rod 89 which is the second toner amount detecting device to a developing device constituting portion. The toner amount detecting devices constituted by the first electrode 81, the second electrode 82, the third electrode 83 and the antenna rod 89 are realized by detecting the capacitance between the space surrounded by the electrodes 81, 82, 83 or the antenna rod 89 and the developing roller 12. Accordingly, the positional accuracy of each electrode is very important. Particularly the intervals among the electrodes 81, 82 and 83 and the position of each electrode relative to the developing roller 12 and the developing blade 18 need to be determined accurately to detect the amount of toner accurately. Also, in the present embodiment, each electrode is disposed near the developing roller 12 on which the toner may remain to the last so that the time when a blank image occurs can be detected accurately. So, in the present embodiment, as shown in FIGS. 4, 5 and 8, the electrodes 81, 82, 83 and the antenna rod 89 are attached to the developing frame 13.

(Attachment of the Electrodes)

The first electrode 81 is positioned by a positioning boss 13*c* provided on the attachment surface 13*b* of the developing frame 13. It is stuck on the attachment surface 13*b* by a pressure-sensitive-adhesive double coated tape. The method of attaching the electrode is not limited to the pressure-sensitive-adhesive double coated tape, but yet in order to detect a blank image, the first electrode 81 is provided near the developing roller 12 and the developing blade 18 by which the toner is consumed lastly. Therefore, in some cases, it is difficult to secure a space for screwing in the developing frame 13. Accordingly, in the present embodiment, the fixing by the pressure-sensitive-adhesive double coated tape, which does not require such a space, is adopted.

There is an arm portion 81*a* on one end portion of the first electrode 81, and an incised clinch 81*b* is constructed on that end portion. When the first electrode 81 is attached to the developing frame 13, the incised clinch 81*b* comes into the groove 13*d* of the developing frame 13. On the other hand, there is a hole 13*e* extending from the interior to the exterior of the developing frame 13 laterally of the groove 13*d* of the developing frame 13. The position of that hole is aligned with the hole 81*c* of the incised clinch 81*b*. The third electrode 83 has arm portions 83*a* and 83*b* on the opposite ends thereof. The arm portions 83*a* and 83*b* are placed on the attachment portions 13*i* and 13*j*, respectively, of the developing frame 13 and fixed by screws. Incised clinch 83*c*, which is similar in shape to the incised clinch 81*b* of the first electrode 81, is constructed on the end portion of the arm portion 83*a*, and when the third electrode 83 is attached to the developing frame 13, the incised clinch 83*c*, which is and the incised clinch 81*b* are arranged side by side. The third electrode 83 is attached to the developing frame 13 after the attachment of the first electrode 81. When the third electrode 83 is incorporated, the incised clinch 83*c* thereof comes into contact with the arm portion 81*a* of the first electrode 81. In this state, the holes of the incised clinch 81*b* and the incised clinch 83*c* are arranged side by side. Thereby, the incised clinch 83*c* corrects the position of the incised clinch 81*b*. Thereby, the assembling property of the press-fit of an electrode bar 25 thereafter is improved. Also, an elastic seal member 24 is shaped so as to fit into the hole 13*e* of the developing frame 13. Here, the elastic seal member 24 is press-fitted in from the outside of the developing frame 13. The elastic seal member 24 is described in Japanese Patent Application Laid-Open No. 8-314359. Thereafter, the electrode bar 25 is inserted into the developing frame 13 through the seal member 24. It is then press-fitted into the incised clinch 81*b* and incised clinch 83*c* in the interior of the frame, and the first electrode 81 and the third electrode 83 are electrically connected together.

As shown in FIGS. 5 and 8, the second electrode 82 is positioned by the positioning boss 13*h* of the developing frame 13. It is fixed by screws. At this time, by one of the screws, an electrode plate 26 is fastened with the second electrode 82, and effects the wiring to the outside of the developing frame 13. It is desirable to assemble the second electrode 82 after the attachment of the first electrode 81 so that the assembling property of the first electrode 81 may not be spoiled.

Figure 11:
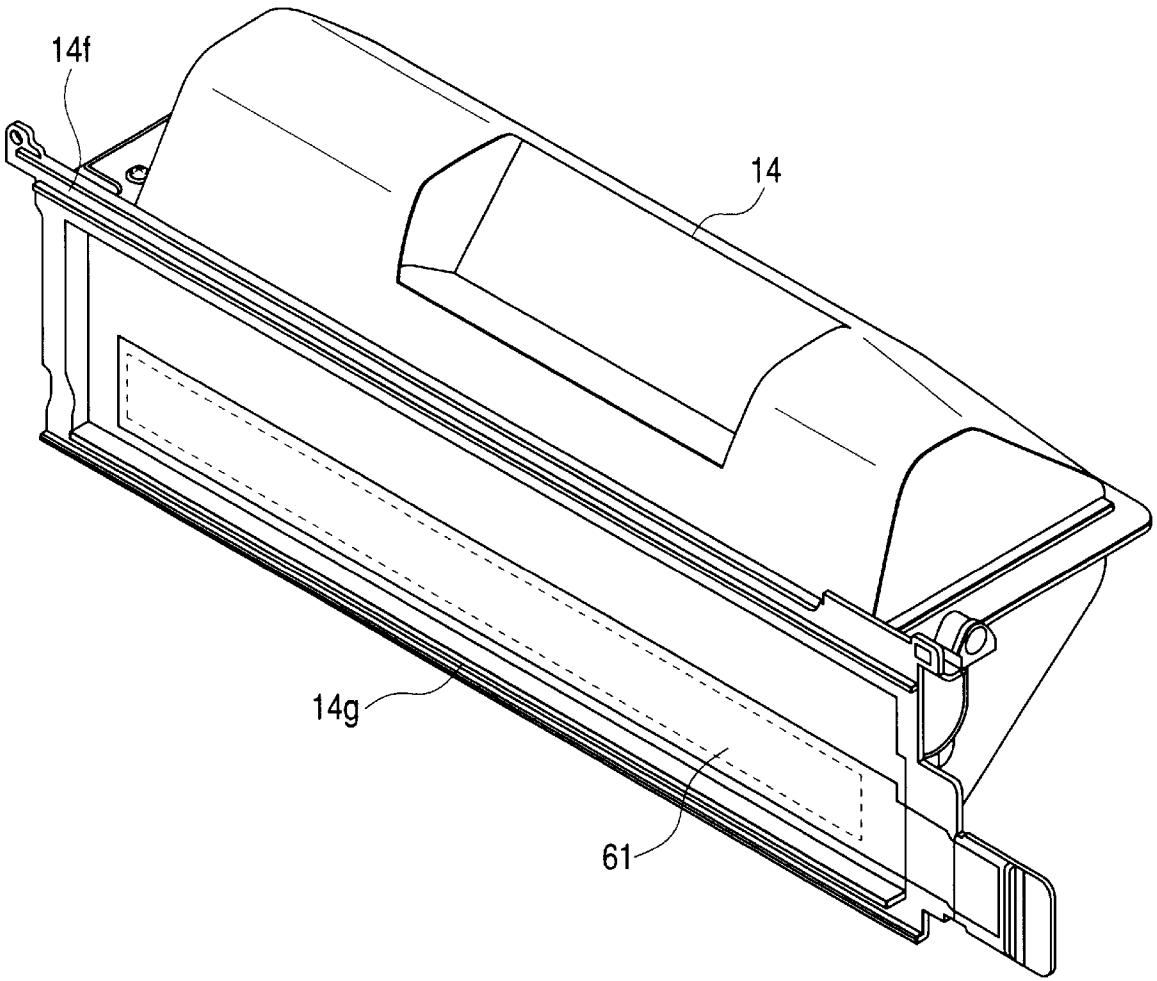
FIG. 11 illustrates a method of remanufacturing a toner containing portion according to the present embodiment.

A description will now be provided of a uniting construction for the developing frame 13 and the toner containing portion 14. As shown in FIGS. 5, 8 and 11, convex portions 13*f* and 13*g* fitted in uniting concave grooves 14*f* and 14*g*, respectively, formed in the toner containing portion 14 are provided on the joined surface of the developing frame 13 with the toner containing portion 14. Triangular ribs for ultrasonic welding are provided on the top surfaces of these convex portions 13*f* and 13*g*. Also, seal members 27, 28 and 29 for preventing the leakage of the toner from between the developing frame 13 and the toner containing portion 14 are stuck around the opposite end portions of the developing frame 13 and the contact portion 26*a* of the electrode plate 26. The seal members 27, 28 and 29 use a sponge-like material.

The developing frame 13 and the toner containing portion 14, into each of which the parts have been incorporated, are pressed with the concave grooves 14*f* and 14*g* of the toner containing portion 14 and the convex portions 13*f* and 13*g* of the developing frame 13 fitted together. Ultrasonic vibration is applied to between the concave grooves and the convex portions. Thereupon, the aforementioned triangular ribs are melted by frictional heat and are welded to the bottoms of the concave grooves, whereby the developing frame 13 and the toner containing portion 14 are integrally united together.

In the present construction, an electrical contact 23 is attached to the toner containing portion 14. The electrical contact 23 is provided with a contact portion 23*a* to be contacted with the main body 100 of the apparatus and a contact portion 23*b* to be contacted with the electrode plate 26. The contact portion 23*b* and the electrode plate 26 are electrically connected together when the developing frame 13 and the toner containing portion 14 are united together.

Figure 6:
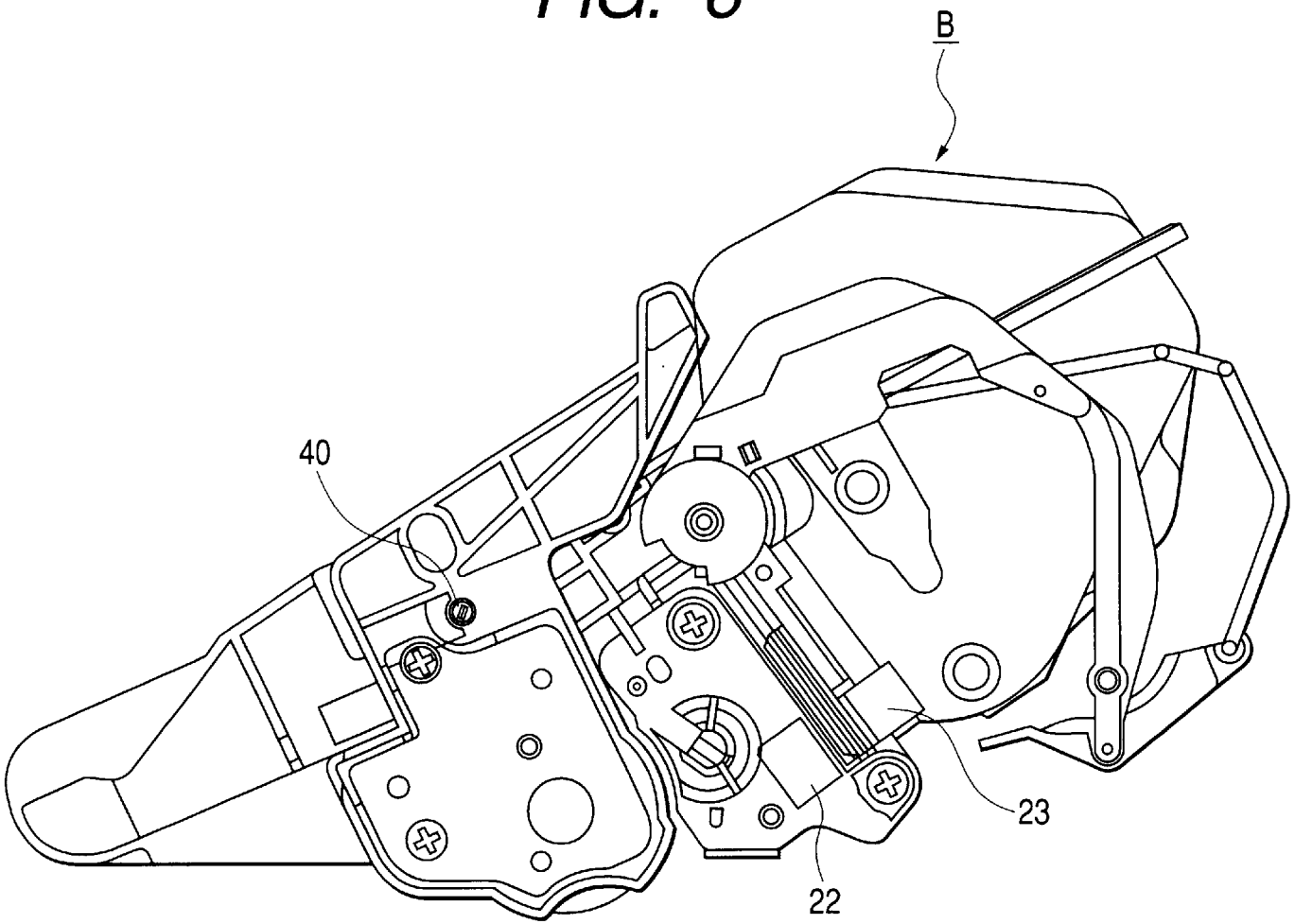
FIG. 6 is a side view of the process cartridge according to the present embodiment.
Figure 7:
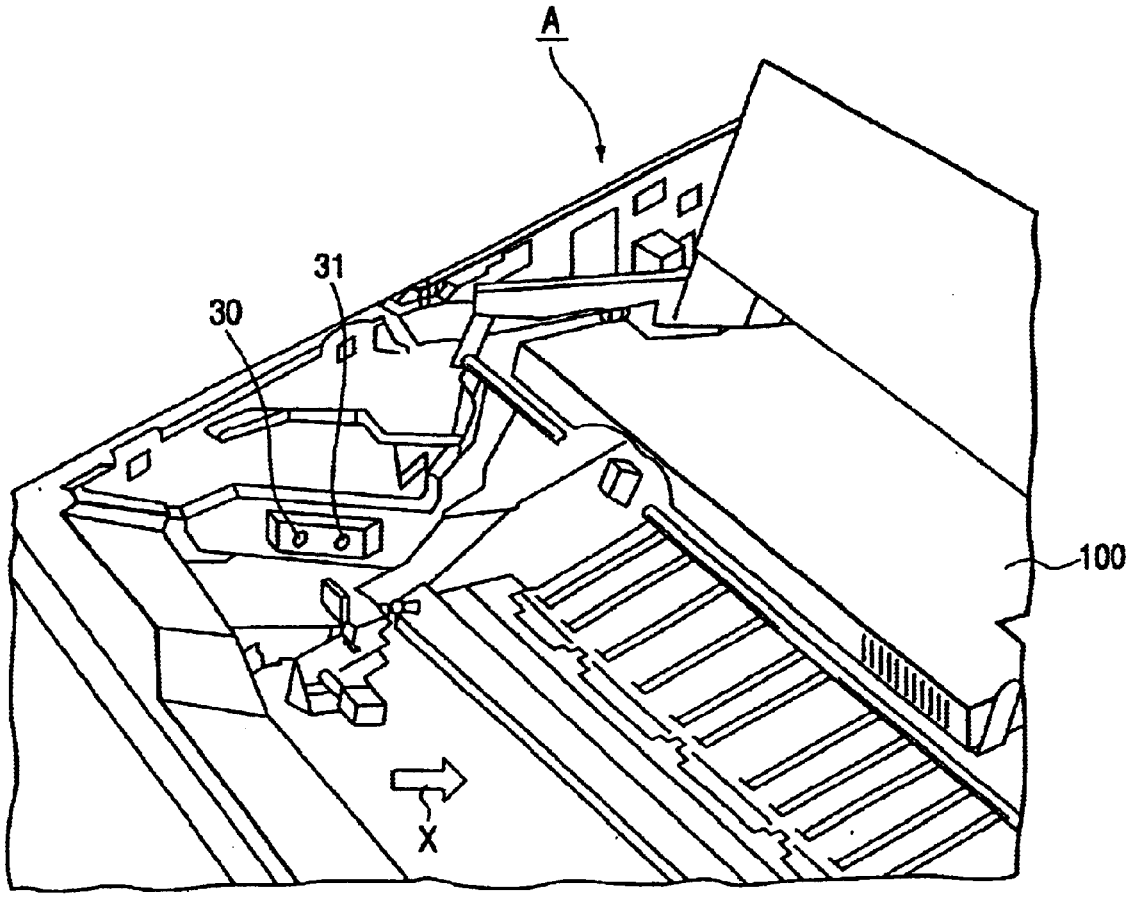
FIG. 7 shows a mounting portion for mounting the process cartridge to the main body of the image forming apparatus according to the present embodiment.

As shown in FIG. 4, a holder 90 for rotatably supporting the developing roller 12 through a bearing is attached to a side portion of the developing frame 13. This holder 90 has attached thereto an electrical contact 22 for electrically connecting the image forming apparatus A and the process cartridge B together. The electrical contact 22 is provided with a contact portion 22*a*, and when the holder 90 is attached to the developing frame 13, the contact portion 22*a* comes into contact with the electrode bar 25. Thereby, the electrical contact 22, the first electrode 81 and the third electrode 83 are electrically connected together. On a side of the thus assembled process cartridge B, as shown in FIG. 6, there are disposed the electrical contacts 22 and 23 of the toner amount detecting devices. As shown in FIG. 7, the electrical contacts 22 and 23 are electrically connected to contacts 30 and 31, respectively, disposed in the main body 100 of the image forming apparatus when the process cartridge B is mounted to the main body 100 of the apparatus in the direction indicated by the arrow X.

[Method of Disassembling and Remanufacturing the Process Cartridge B]

(Method of Disassembling the Process Cartridge B)

A description will now be provided of a method of disassembling the process cartridge B.

The aforedescribed pin 40 is first removed by pulling it out from the outside of it or pushing it out from the inside of it to thereby separate the drum unit 19 and the developing container D from each other.

The drum unit 19 removes the waste toner in the waste toner reservoir 9*b*. The photosensitive drum 7, the cleaning means 9 such as the cleaning blade 9*a* and the charging roller 8 are then reused or interchanged. Thereby, the drum unit 19 is remanufactured.

(Method of Disassembling the Developing Container D)

As regards the disassembled developing container D, the developing roller 12 and the developing blade 18 are detached, whereafter the toner remaining in the toner containing portion (developer containing portion) 14 is removed, and the opening portion 14*p* of the toner containing portion 14 is resealed by the seal member. In order to effect the resupply of a fresh toner, the developing frame 13 and the toner frame (developer frame) 11 are separated from each other. The toner frame 11 has a toner containing portion 14.

Figure 9:
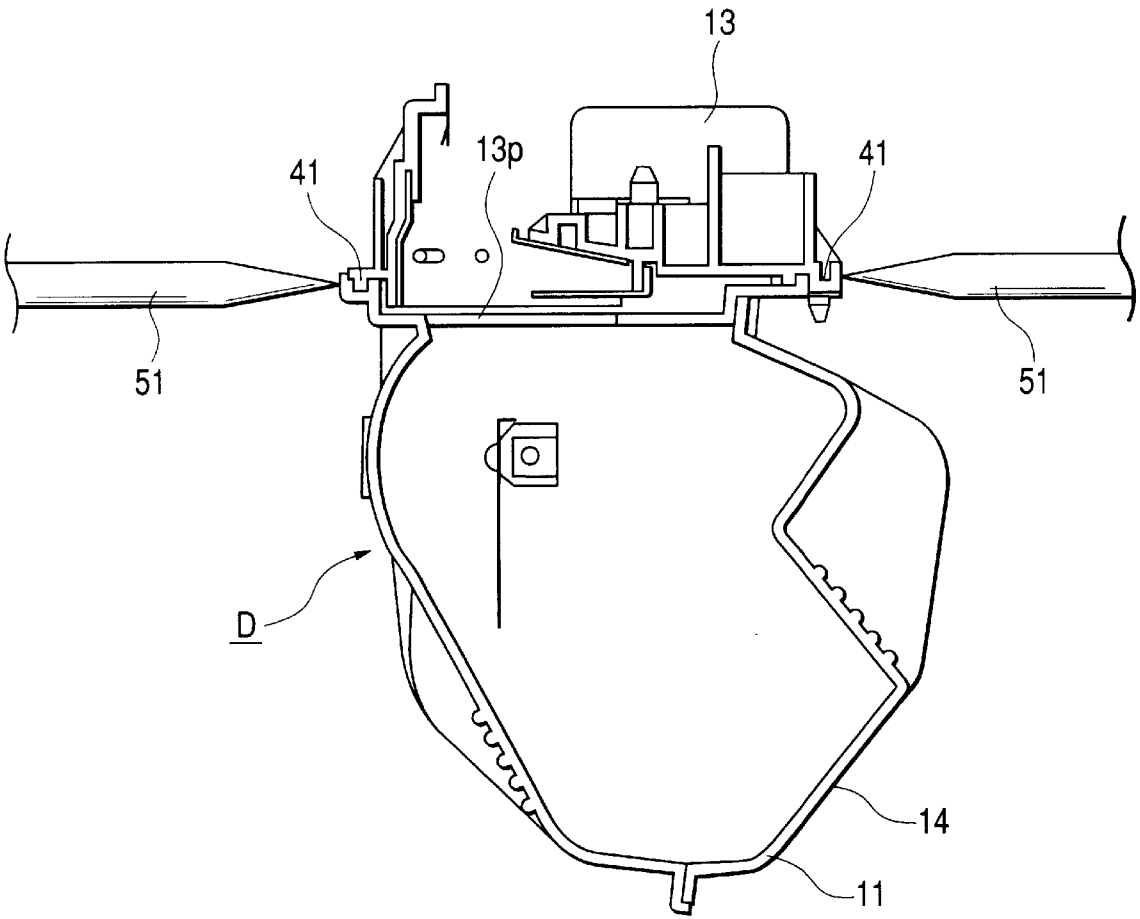
FIG. 9 illustrates a method of disassembling a developing container according to the present embodiment.
Figure 10:
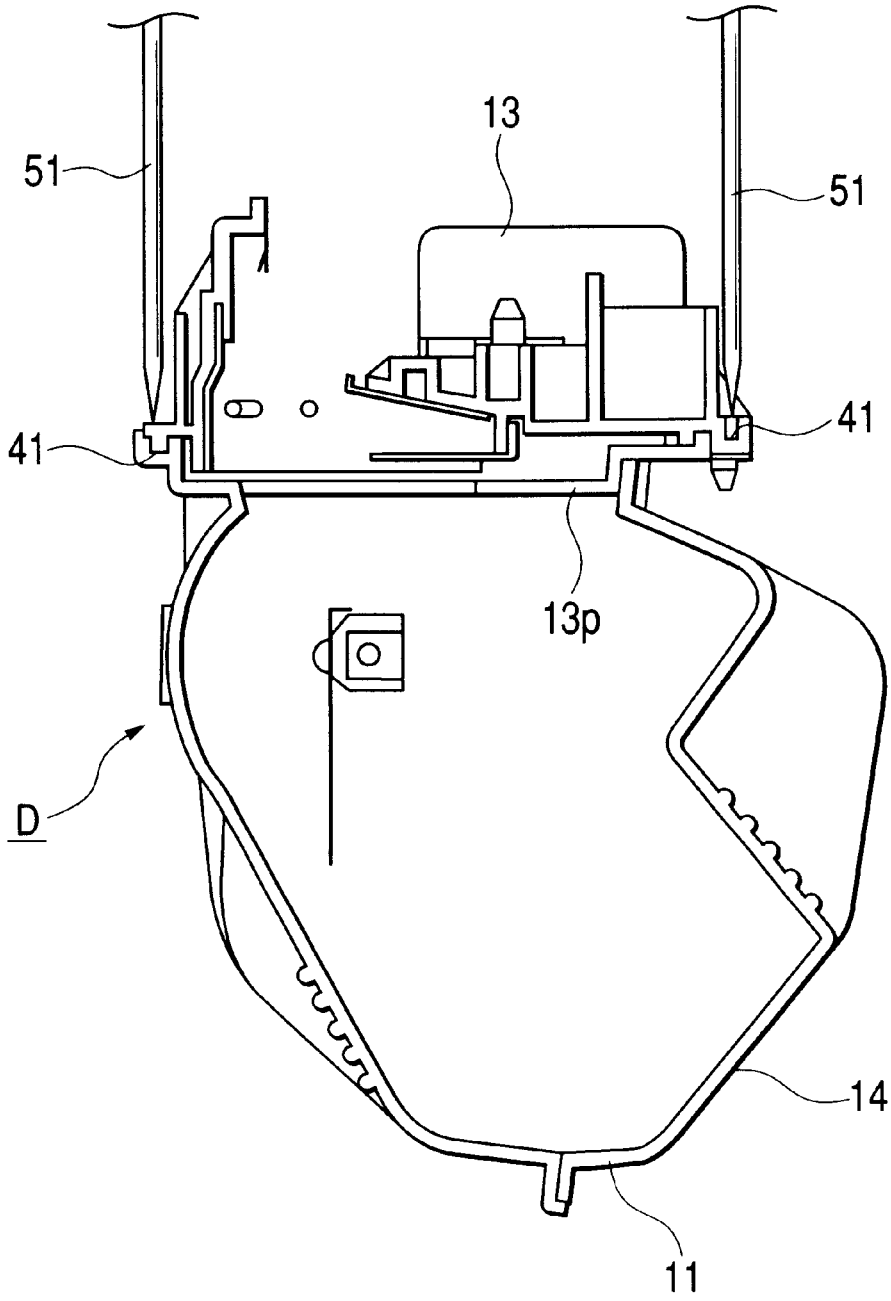
FIG. 10 illustrates the method of disassembling the developing container according to the present embodiment.

As previously described, the developing frame 13 and the toner containing portion 14 are united together as by ultrasonic welding and cannot be easily separated from each other. So, as shown in FIG. 9, to separate the developing frame 13 and the toner frame 11 from each other, their welded surfaces are cut by a cutter 51, ultrasonic cutting work, laser working or the like. When for example, the welded surfaces are to be cut by the cutter 51, a welded joined surface 41 is cut as shown in FIG. 9. Besides, as shown, for example, in FIG. 10, escape may be made from the welded portion and cutting may be made along the joined surface 41. In the case of ultrasonic cutting work as well, the joined surface 41 is melted and likewise cut by a cutter to which ultrasonic vibration is applied. Also, in the case of laser working, the arrival distance of a laser beam is restricted to a portion to be cut.

(Method of Uniting the Developing Frame 13 and the Toner Containing Portion 14 Together)

In the separated toner containing portion 14, the removal of the toner is effected. Thereafter, as shown in FIG. 11, a toner seal member 61 is fixed to an opening portion as by heat welding, adhesive securing or a pressure sensitive adhesive double coated tape to thereby reseal the opening portion. The resupply of a fresh toner is then effected.

Figure 12:
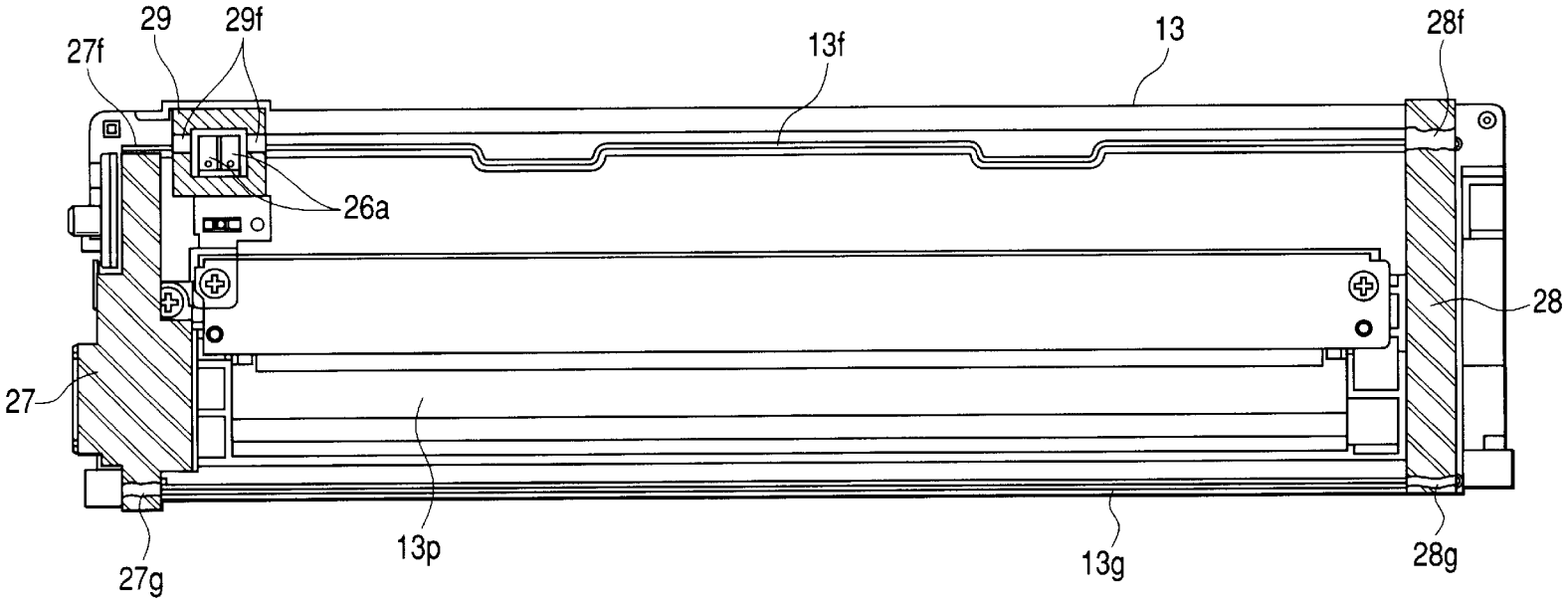
FIG. 12 illustrates a method of remanufacturing a developing frame according to the present embodiment.

The disassembled developing frame 13 is in a state as shown in FIG. 12 wherein the overlapping portions 27*f*, 28*f*, 29*f*, 27*g* and 28*g* of the triangular ribs of the convex portions 13*f* and 13*g* melted and united by an ultrasonic wave during uniting and the convex portions 13*f* and 13*g* of seals 27, 28 and 29 are melted. Therefore, these portions are sealed so that the toner may not leak therefrom when they are reunited.

Figure 13:
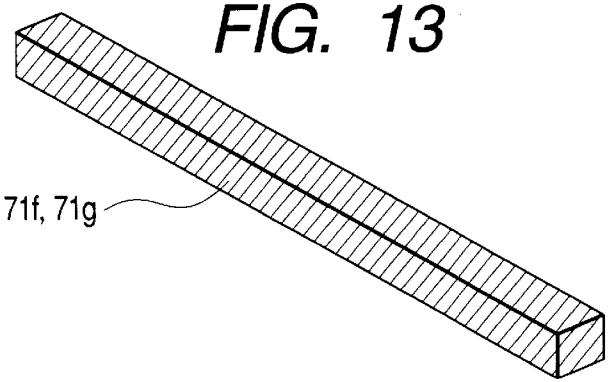
FIG. 13 illustrates a seal member according to the present embodiment.
Figure 14:
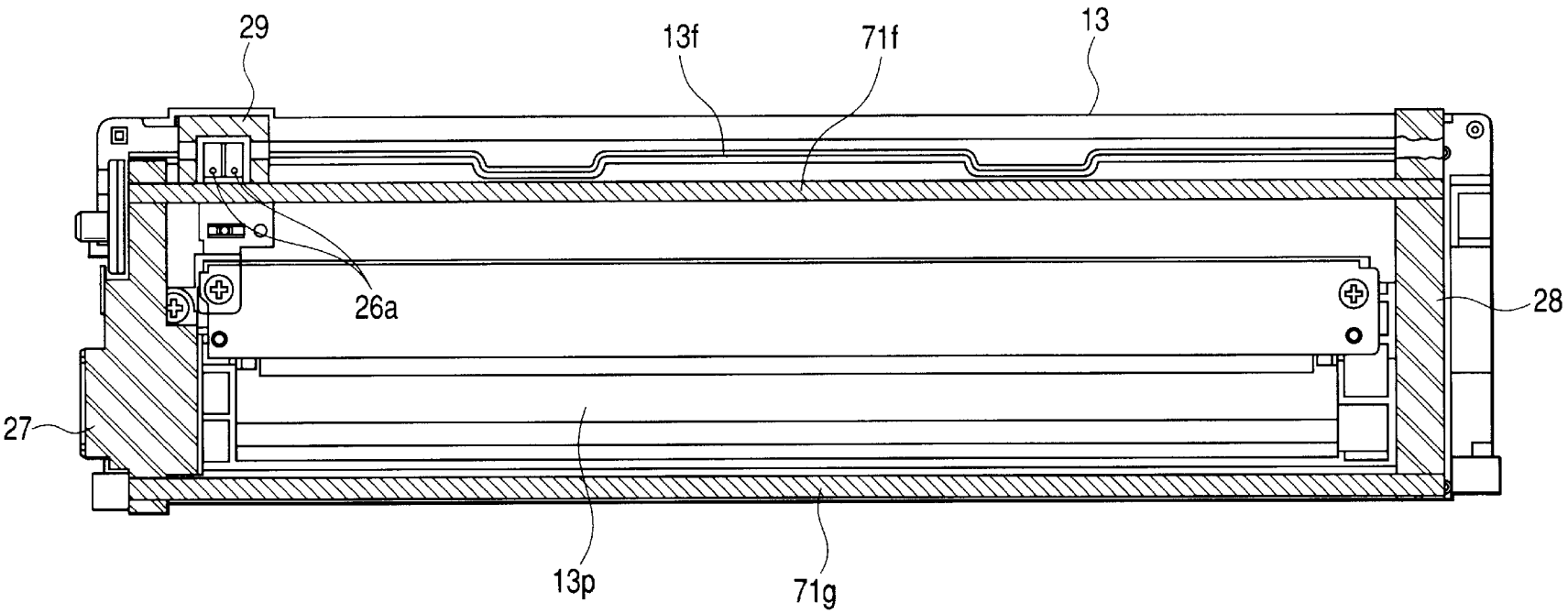
FIG. 14 illustrates the method of remanufacturing the developing frame according to the present embodiment.

So, use is made of a sponge-like seal member 71*f* (FIG. 13) made of foamed polyurethane having substantially the same cross-sectional shape. This seal member 71*f*, as shown in FIG. 14, is stuck astride the seals 27, 28 and 29 between the overlapping portions 27*f*, 28*f*, 29*f* and the opening upper side (the lower side of the overlapping portions 27*f*, 28*f*, 29*f* as viewed in FIG. 14) of the toner containing portion 14, by a pressure sensitive adhesive double coated tape. Thereby, the upper side of the developing frame 13 is sealed. Likewise a seal member 71*g* is stuck between the overlapping portions 27*g*, 28*g* and the opening lower side (the upper side of the overlapping portions 27*g*, 28*g* as viewed in FIG. 14). Thereby, the lower side of the developing frame 13 is sealed.

By thus sticking the seal members, it becomes possible to seal all of the seals 27, 28 and 29 by the sponge-like seal members 71*f* and 71*g* of a simple shape with respect to the upper and lower portions of the developing frame 13. Accordingly, the number of the remanufacturing steps and the number of parts for remanufacturing can be curtailed. Further, the existing seal portion can be utilized effectively. Also, the sponge-like seal member 71*f* is stuck on the contact portion 26*a* of the electrode plate 26 to the opening side of the toner containing portion 14. Thereby, the adherence of the toner to the contact connecting portion between the contact portion 23*b* for detecting the remaining amount of toner and the contact portion 26*a* of the electrode plate 26 can be prevented. Accordingly, the reliability of the contact can be improved.

Figure 15:
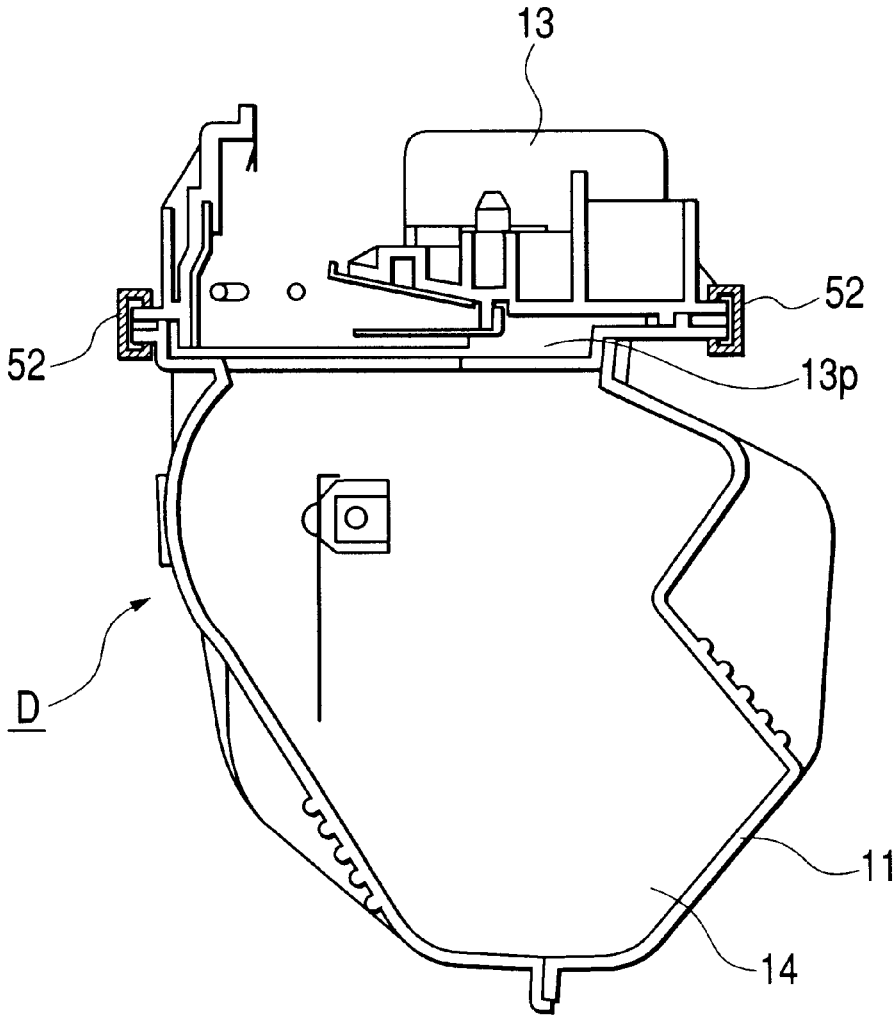
FIG. 15 illustrates the method of remanufacturing the developing frame according to the present embodiment.

Thereafter, as shown in FIG. 15, the remanufactured developing frame 13 and toner containing portion 14 are united together by a uniting metal fitting 52 which is a clip comprised of a U-shaped spring material. This uniting can also be accomplished by the use of a method such as adhesive securing, pressure sensitive adhesive double coated tape sticking, ultrasonic welding or heat welding.

(Assembling of the Process Cartridge)

Next, the reassembling of the process cartridge B is done by a procedure converse to that of disassembling. First, the parts of the drum unit 19 and the developing container D are suitably inspected, and reusable parts are cleaned and assembled. Also, unreusable parts are interchanged with new ones, which are then assembled. Thereafter, the assembled drum unit 19 and developing container D are united together by a uniting pin 40. Thus, the process cartridge is remanufactured.

In the first embodiment, a description has been provided of a construction in which the seal members are stuck on the developing frame 13 to thereby unite it. However, a similar effect can also be obtained by adopting a construction in which a seal member is stuck on the corresponding portion of the toner containing portion 14.

In the aforedescribed embodiment, used process cartridges are collected and disassembled. The same parts taken out of the respective process cartridges by disassembling are gathered. Thereafter, these parts are used, or in some cases, new parts (parts which are not reused) are used instead of some parts, and the process cartridges are remanufactured by the aforedescribed remanufacturing method. Also, in the aforedescribed embodiment, a used process cartridge is collected and disassembled. Parts taken out of the process cartridge are used, or in some cases, new parts (parts which are not reused) or parts taken out of another process cartridge are used instead of some parts, and the process cartridge is remanufactured by the aforedescribed remanufacturing method.

As described above, according to the aforedescribed embodiment, when the developing frame and the toner frame are to be reunited after being separated from each other, remanufacturing which is high in toner sealing effect can be accomplished. Also, a remanufacturing method which is high in the reliability of the aforedescribed remaining amount detecting contact portion can be realized at a low cost.

Further, it is possible to reutilize the existing seal members partly as seal members without stripping them off. Therefore, a remanufacturing method which can curtail the number of the disassembling steps can be realized.

A description will now be provided of another embodiment of the toner seal when the toner frame 11 and the developing frame 13 are reunited.

Figure 16:
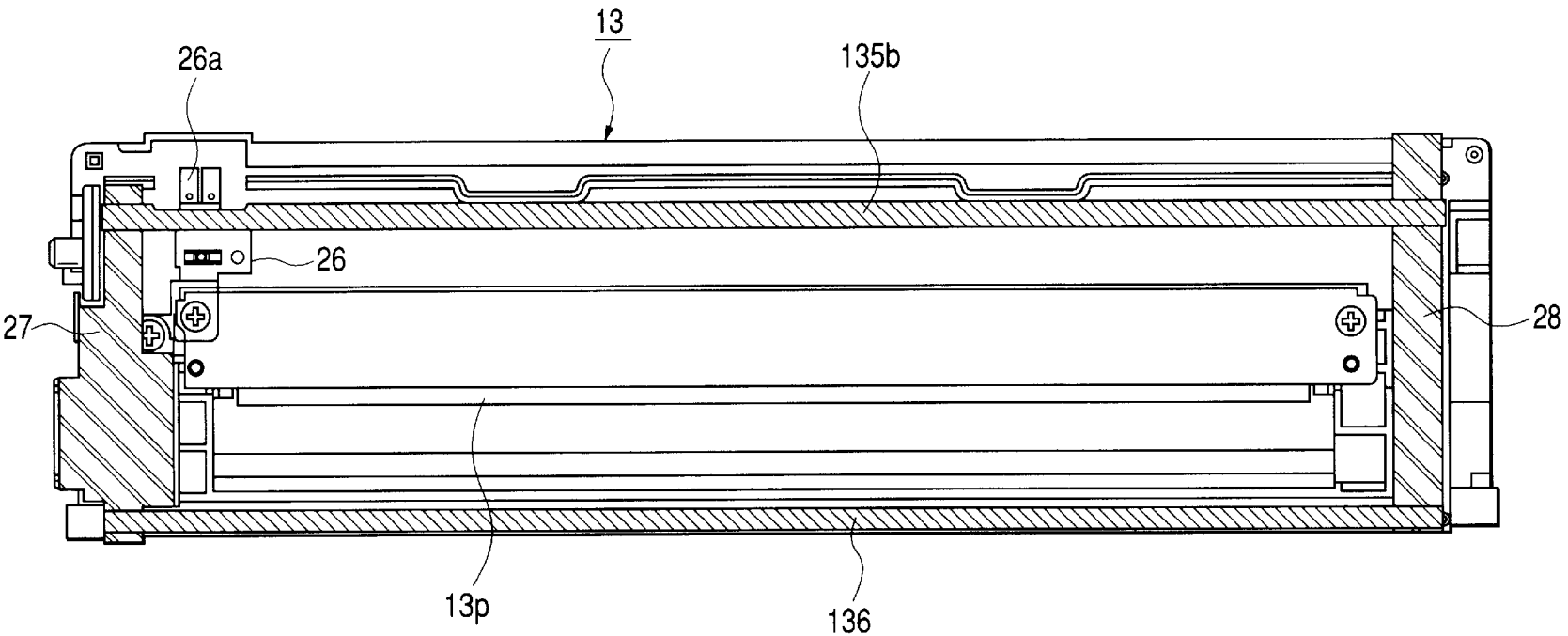
FIG. 16 illustrates the construction of the seal member.
Figure 17:
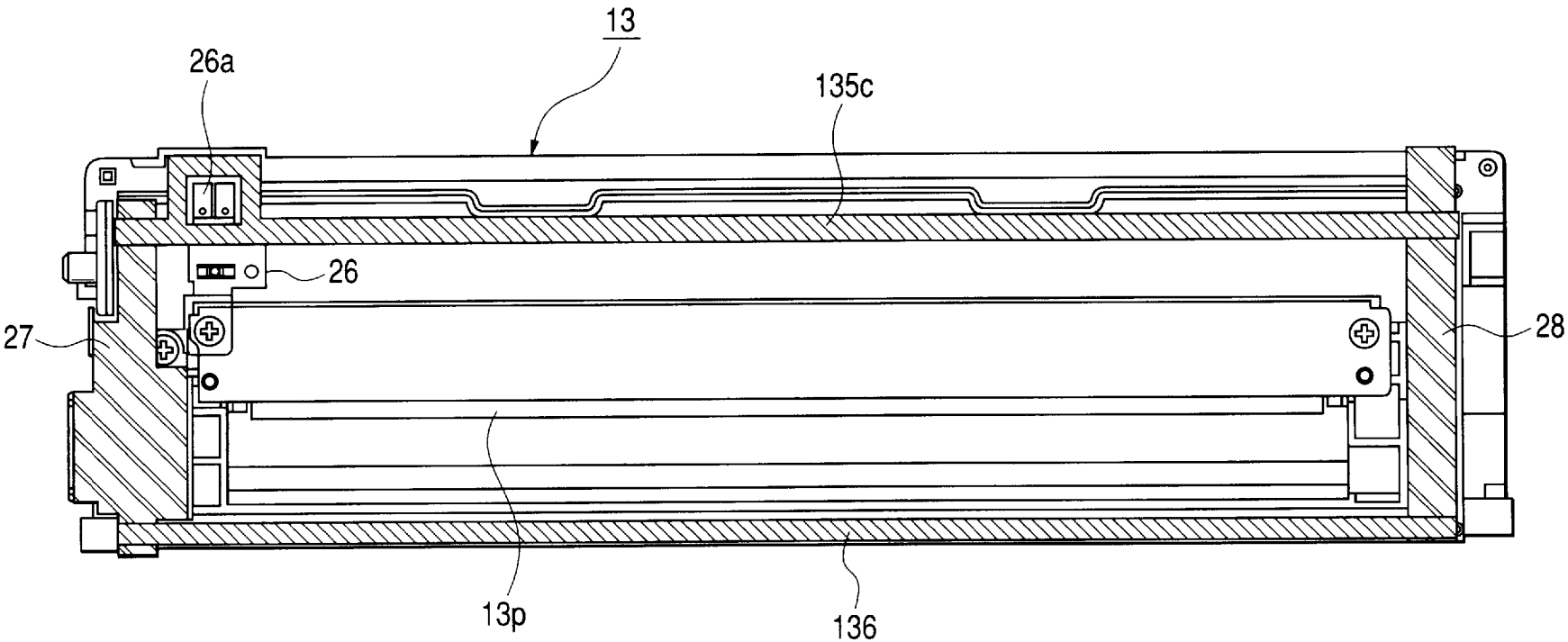
FIG. 17 illustrates the construction of the seal member.

The seal member 29 melted by welding is removed, and sponge-like seal members 135*b* and 135*c* shown in FIGS. 16 and 17, respectively, are stuck astride the seal members 27 and 28 between the overlapping portions 27*f*, 28*f* and the opening upper side of the toner containing portion 14 shown in FIG. 12. Thereby, the upper side of the developing frame 13 is sealed. Likewise a seal member 136 is stuck between the overlapping portions 27*g*, 28*g* and the lower side of the opening. Thereby, the lower side of the developing frame 13 is sealed.

Figure 18:
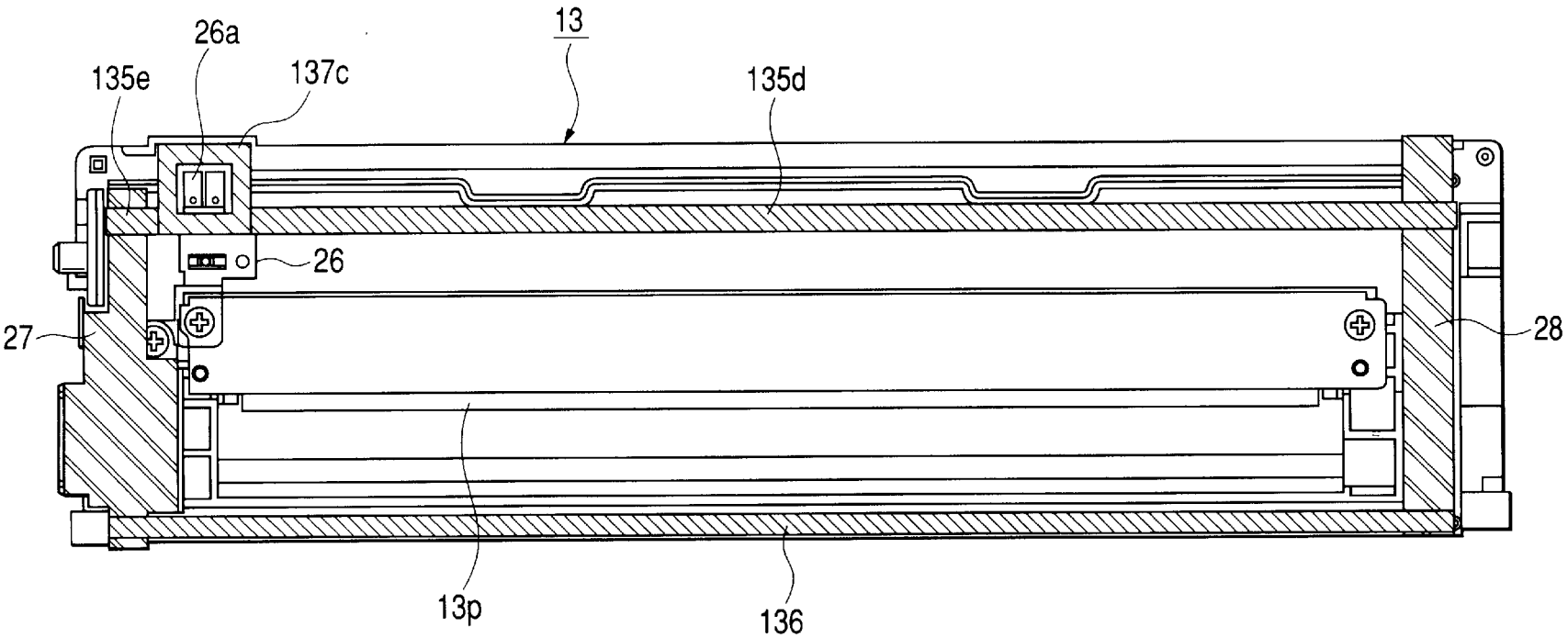
FIG. 18 illustrates the construction of the seal member.

By thus sticking the seal members, it becomes possible to seal all of the seal members 27, 28 and 29 by the sponge-like seal member 135*b* or 135*c* and the seal member 136. The seal member 135*b* need not always be a sponge-like one, but may be divided into a plurality like seal members 135*d*, 135*e* and 137*c* shown in FIG. 18.

Figure 19:
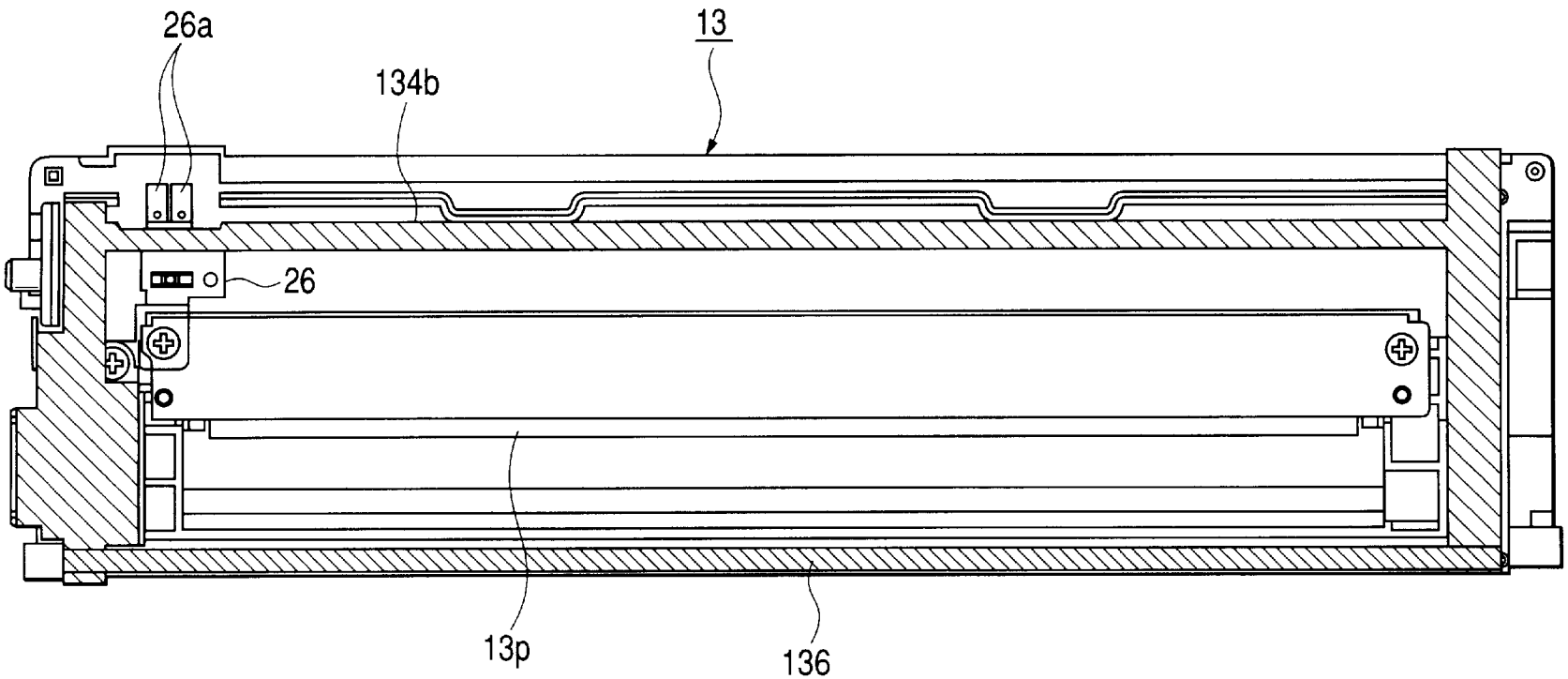
FIG. 19 illustrates the construction of the seal member.
Figure 20:
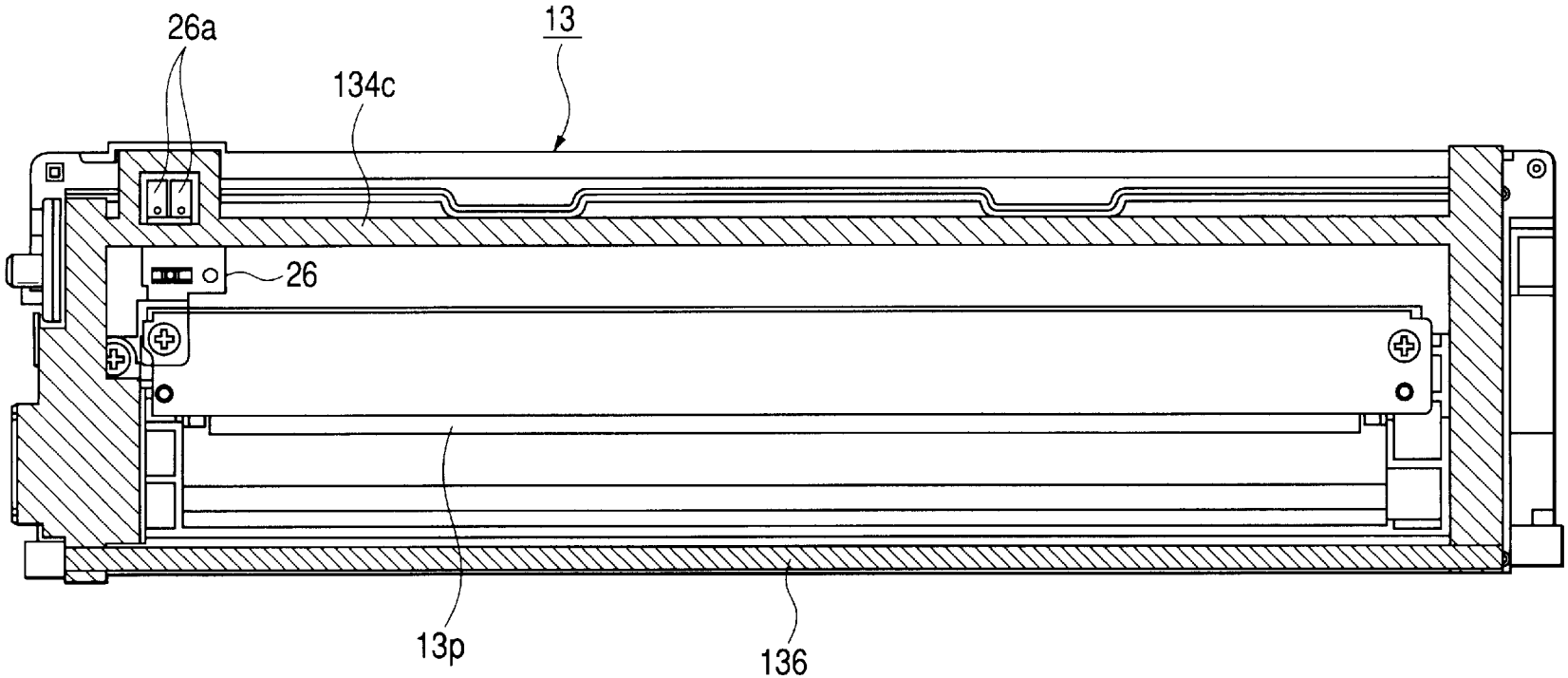
FIG. 20 illustrates the construction of the seal member.

Also, as shown in FIGS. 19 and 20, the seal members 27 and 28 partly melted by welding and effecting the sealing of the lengthwisely opposite ends are removed. Seal members 134*b* and 134*c* in which sponge-like seal members for sealing the widthwise opposite ends and seal members at the lengthwise opposite ends are integral with each other may be stuck and united together. Again by this method, sealing can be reliably accomplished. Also, as shown in FIGS. 16, 17, 18, 19 and 20, the sponge-like seal members 135*b*, 135*c*, 137*c*, 134*b* and 134*c* are stuck between the contact portion 26*a* of the electrode plate 26 and the upper side of the opening of the toner containing portion 14 as viewed in the figures. Thereby, the adherence of the toner to the contact connecting portion between the contact portion 23*b* for detecting the remaining amount of toner and the contact portion 26*a* of the electrode plate 26 can be prevented. Accordingly, the electrical reliability of the contact portions can be improved.

Figure 21:
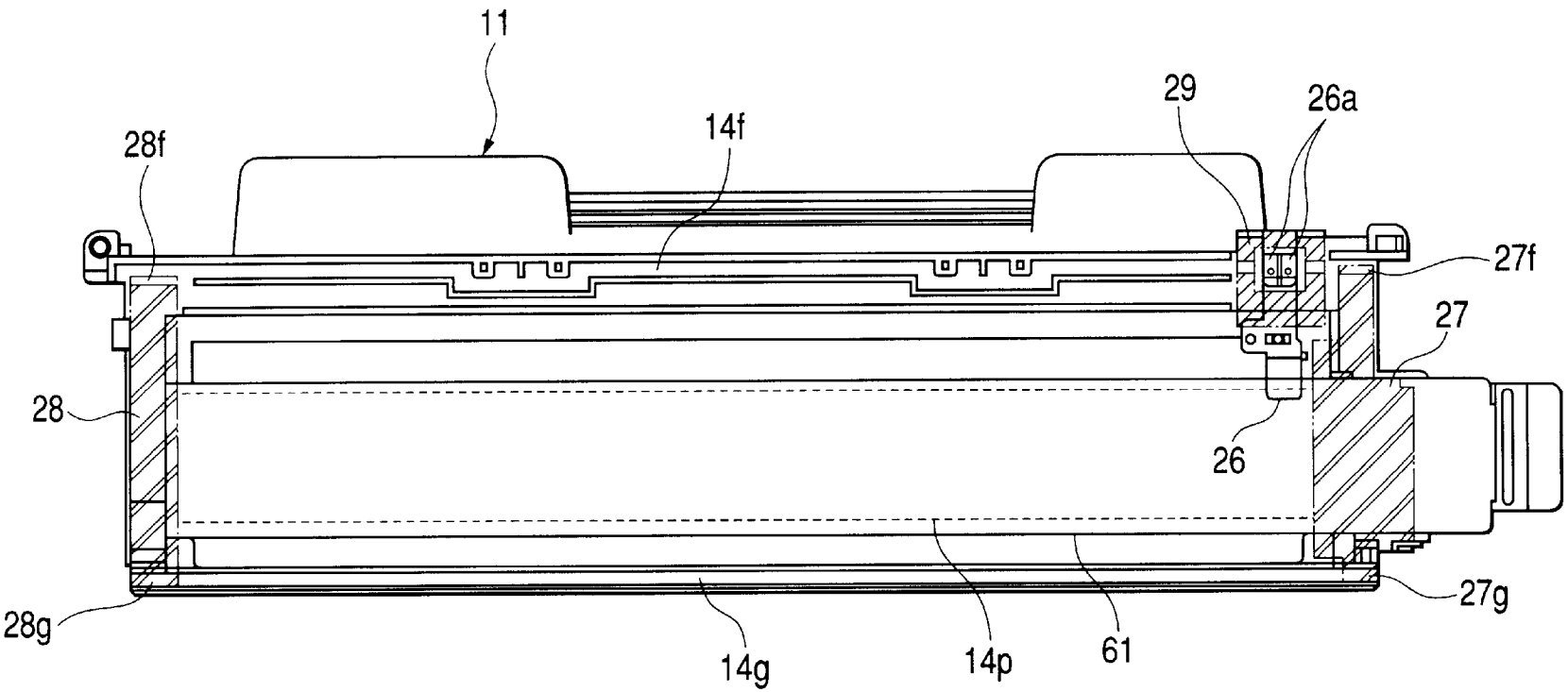
FIG. 21 illustrates the construction of a seal member according to another embodiment.
Figure 22:
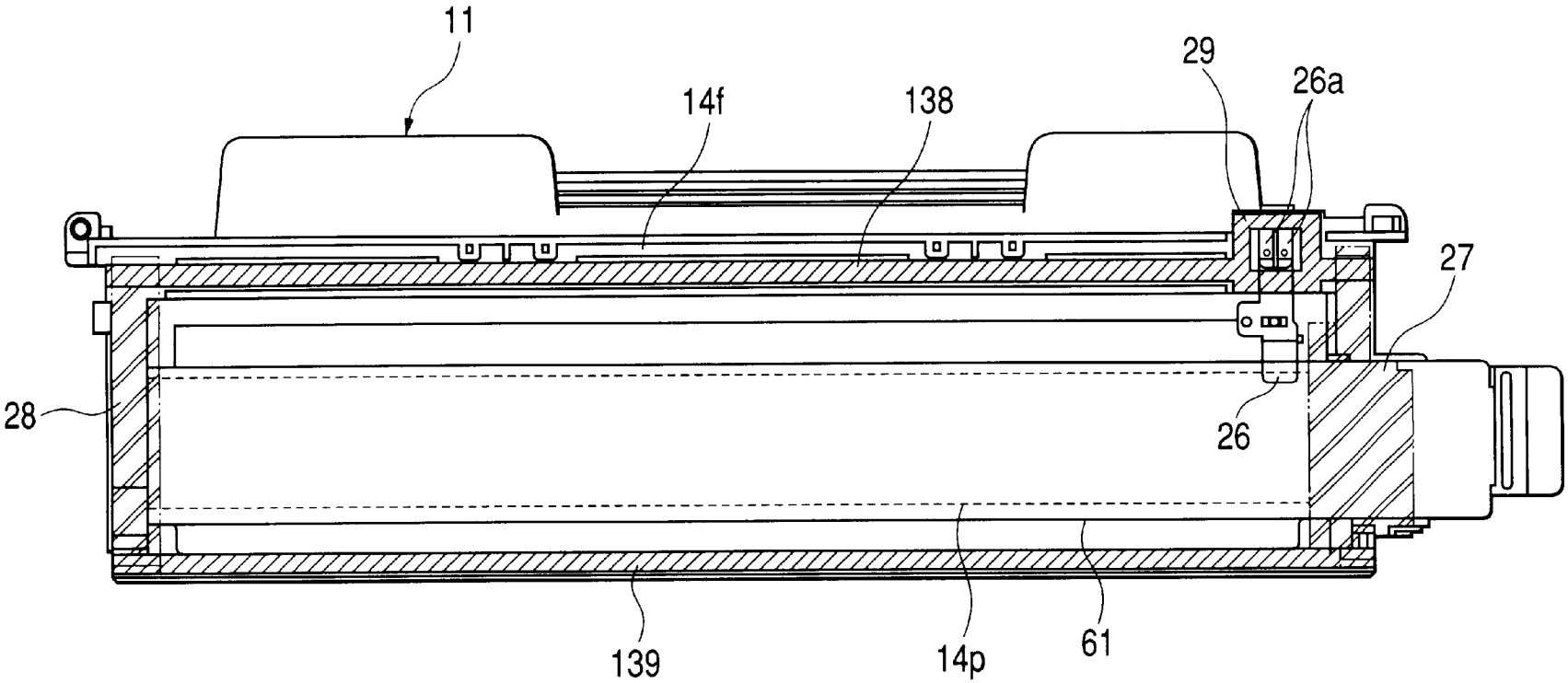
FIG. 22 illustrates the construction of a seal member according to another embodiment.

Another embodiment of the method of remanufacturing the developing device and the process cartridge will now be described with reference to the drawings. FIGS. 21 and 22 illustrate the construction of seal members according to the present embodiment.

The aforedescribed embodiment is one in which the seal members 135*b*, 135*c*, etc. are stuck on the developing frame 13 when the developing device and the process cartridge are remanufactured. In contrast, the present embodiment is one in which seal members are stuck on the toner frame 11.

FIGS. 21 and 22 are views of the toner frame 11 as it is seen from the opening 14*p* side. FIG. 21 shows the state before seal members are stuck, and FIG. 22 shows the state after the seal members have been stuck. The stuck position of a seal member 138 on the upper side of the toner frame 11 is a position corresponding to between the portions 27*f*, 28*f* (the vicinity of the concave groove 14*f*) melted when the developing frame 13 and the toner frame 11 were weld-united and the upper side of the opening 14*p*, and avoiding the contact portion 26*a* of the electrode plate 26. Also, the stuck position of a seal member 139 on the lower side of the toner frame 11 is a position corresponding to between the portions 27*g*, 28*g* (the vicinity of the concave groove 14*g*) melted when the developing frame 13 and the toner frame 11 were weld-united and the lower side of the opening 14*p*. When the seal members 138 and 139 are thus stuck on the toner frame 11 side, the leakage of the toner to the outside of the process cartridge B can also be prevented as in the aforedescribed embodiment. Further, the adherence of the toner to the contact portion 26*a* can also be prevented. Accordingly, the electrical reliability of the contact portion can be improved.

The afore described embodiments are summarized as follows.

1. A method of remanufacturing a process cartridge B detachably mountable to the main body 100 of an electrophotographic image forming apparatus comprises:
   the separating step of removing a pin 40 to thereby separate a drum unit 19, for supporting an electrophotographic photosensitive drum 7, and a developing container D, having a developing frame 13 for supporting a developing roller 12 and a developer frame 11 having a developer containing portion 14 containing a developer therein, from each other;
   the developing container separating step of separating the developing frame 13 and the developer frame 11 from each other to thereby separate the developing container D;
   the developer resupplying step of resupplying the developer to the developer containing portion 14 of the developer frame 11;
   the developing container reconstructing step of superposing reseal members 71*f*, 71*g* on end portion seal members provided at one and the other lengthwise ends of a developer supply opening 13*p* for supplying the developer contained in the developer containing portion 14 to the developing roller 12, and interposing reseal members 71*f*, 71*g* on one and the other widthwise ends of the developer supply opening along the lengthwise direction of the developer supply opening 13*p*, and reuniting the developing frame 13 and the developer frame 11 to thereby reconstruct the developing container D; and
   the reuniting step of reuniting the reconstructed developing container D and the drum unit 19.
2. At the developing container reconstructing step, the reseal member 71*f* is superposed and interposed on a connecting portion seal member 29 sealing an electrical contact 26*a* so that the developer may not adhere to the electrical contact 26*a* disposed at the uniting portion between the developing frame 13 and the developer frame 11 to effect electrical connection astride the developing frame 13 and the developer frame 11.
3. A method of remanufacturing a process cartridge B detachably mountable to the main body 100 of an electrophotographic image forming apparatus comprises:
   the separating step of removing a pin 40 to thereby separate a drum unit 19, for supporting an electrophotographic photosensitive drum 7, and a developing container D, having a developing frame 13 for supporting a developing roller 12 and a developer frame 11 having a developer containing portion 14 containing a developer therein, from each other;
   the developing container separating step of separating the developing frame 13 and the developer frame 11 from each other to thereby separate the developing container D;
   the developer resupplying step of resupplying the developer to the developer containing portion 14 of the developer frame 11;
   the developing container reconstructing step of stripping off a connecting portion seal member 29 sealing an electrical contact 26*a* so that the developer may not adhere to the electrical contact 26*a* disposed in the uniting portion between the developing frame 13 and the developer frame 11 to effect electrical connection astride the developing frame 13 and the developer frame 11, and thereafter interposing reseal members 71*f*, 71*g* on one and the other widthwise ends of a developer supply opening 13*p* for supplying the developer contained in the developer containing portion 14 to the developing roller 12 along the lengthwise direction of the developer supply opening 13*p*, and reuniting the developing frame 13 and the developer frame 11 to thereby reconstruct the developing container D; and
   the reuniting step of reuniting the reconstructed developing container D and the drum unit 19.
4. At the developing container reconstructing step, the reseal members 71*f*, 71*g* are superposed on and interposed between end portion seal members 27, 28 provided at one and the other lengthwise ends of the developer supply opening 13*p*.
5. The reseal member 71*f* is interposed between the developing frame 13 and the developer frame 11 inside the electrical contact in the widthwise direction of the developing frame 13.
6. The reseal members 71*f*, 71*g* are stuck on the developing frame 13, whereby they are interposed between the developing frame 13 and the developer frame 11.

7. The reseal members 71*f*, 71*g* are stuck on the developer frame 11, whereby they are interposed between the developing frame 13 and the developer frame 11.
8. The reseal members 71*f*, 71*g* are formed into a sponge-like shape.
9. A method of remanufacturing a developing device 10 for developing an electrostatic latent image formed on an electrophotographic photosensitive drum 7 comprises:

the developing container separating step of separating a developing frame 13, for supporting a developing roller 12, and a developer frame 11, having a developer containing portion 14 containing therein a developer to be used for the development of the electrostatic latent image by the developing roller 12, from each other;

the developer resupplying step of resupplying the developer to the developer containing portion 14 of the developer frame 11; and the developing container reconstructing step of superposing reseal members 71*f*, 71*g* on end portion seal members 27, 28 provided at one and the other lengthwise ends of a developer supply opening 13*p* for supplying the developer contained in the developer containing portion 14 to the developing roller 12, and interposing the reseal members 71*f*, 71*g* on one and the other widthwise ends of the developer supply opening 13*p* along the lengthwise direction of the developer supply opening 13*p*, and reuniting the developing frame 13 and the developer frame 11 to thereby reconstruct a developing container D.

10. A method of remanufacturing a developing device 10 for developing an electrostatic latent image formed on an electrophotographic photosensitive drum 7 comprises:

the developing container separating step of separating a developing frame 13, for supporting a developing roller 12, and a developer frame 11, having a developer containing portion 14 containing therein a developer to be used for the development of the electrostatic latent image by the developing roller 12, from each other;

the developer resupplying step of resupplying the developer to the developer containing portion 14 of the developer frame 11; and the developing container reconstructing step of stripping off a connecting portion seal member 29 sealing an electrical contact 26*a* so that the developer may not adhere to the electrical contact 26*a* disposed at the uniting portion between the developing frame 13 and the developer frame 11 to effect electrical connection astride the developing frame 13 and the developer frame 11, and thereafter interposing reseal members 71*f*, 71*g* on one and the other widthwise ends of a developer supply opening 13*p* for supplying the developer contained in the developer containing portion 14 to the developing roller 12 along the lengthwise direction of the developer supply opening 13*p*, and reuniting the developing frame 13 and the developer frame 11 to thereby reconstruct a developing container D.

Collecting, disassembling and remanufacturing the used process cartridge according to the present invention includes not only simply disassembling and reassembling it as described above, but also interchanging unreusable parts with new parts, disassembling a plurality of process cartridges and gathering the same parts and effecting reassembly by them, and effecting reassembly by the use of parts taken out of another process cartridge.

The present invention covers the following cases:

(1) A case where in remanufacturing a process cartridge, only parts detached from a process cartridge are reused to effect the remanufacturing of the process cartridge;

(2) A case where in the above-described case (1), regarding parts which have reached the end of their lives, or which are damaged or otherwise cannot be reused, new parts or reusable parts detached from other cartridges are used to effect the remanufacturing of the process cartridge;

(3) A case where in remanufacturing a process cartridge, the same parts detached from a plurality of process cartridges are once gathered, and necessary parts are chosen from those gathered parts and are reused to effect the remanufacturing of the cartridge; and (4) A case where in the above-described case (3), regarding parts which have reached the end of their lives or which are damaged or otherwise cannot be reused, new parts are used to effect the remanufacturing of the cartridge.

The above-mentioned parts are articles constituting the construction described in the appended claims, i.e., some portions of the cartridge. They also cover a minimum unit which can be disassembled, or a case where they are units.

As described above, according to the remanufacturing method of the present invention, the leakage of the developer to the outside can be prevented more reliably.

While the invention has been described with respect to the structure disclosed herein, it is not confined to the details set forth and this application is intended to cover such modifications or changes as may come within the purposes of the improvements or the scope of the following claims.

What is claimed is:

1. A method of remanufacturing a process cartridge detachably mountable to a main body of an electrophotographic image forming apparatus comprising:

a separating step of removing a pin from the process cartridge that holds together a drum unit and a developing container, to thereby separate the drum unit, configured and positioned to support an electrophotographic photosensitive drum, and the developing container, having a developing frame configured and positioned to support a developing roller and a developer frame having a developer containing portion containing a developer therein, from each other;

a developing container separating step of separating the developing frame and the developer frame from each other to thereby separate components of the developing container;

a developer resupplying step of resupplying developer to the developer containing portion of the developer frame;

a developing container reconstructing step of superposing a reseal member on end portion seal members provided at one lengthwise end and the other lengthwise end of a developer supply opening of the developer containing portion, the developer supply opening being configured and positioned to supply the developer contained in the developer containing portion to the developing roller, interposing the reseal member on each of one widthwise end and the other widthwise end of the developer supply opening along a lengthwise direction of the developer supply opening, and reuniting the developing frame and the developer frame to thereby reconstruct the developing container; and a reuniting step of reuniting the reconstructed developing container and the drum unit.

2. A method according to claim 1, wherein the developing frame and the developer frame include a united portion at which the developing frame and the developer frame are to be reunited in said reuniting step of said developing container reconstructing step to reconstruct the developing container and wherein said developing container reconstructing step further comprises the step of interposing the reseal member on a connecting portion seal member sealing an electrical contact disposed at the united portion of the developing frame and the developer frame to effect electrical connection astride the developing frame and the developer frame when the developing frame and the developer frame are reunited to reconstruct the developing container.

3. A method of remanufacturing a process cartridge detachably mountable to a main body of an electrophotographic image forming apparatus comprising:

a separating step of removing a pin from the process cartridge that holds together a drum unit and a developing container, to thereby separate the drum unit, configured and positioned to support an electrophotographic photosensitive drum, and the developing container, having a developing frame configured and positioned to support a developing roller and a developer frame having a developer containing portion containing a developer therein, from each other;

a developing container separating step of separating the developing frame and the developer frame from each other to thereby separate components of the developing container;

a developer resupplying step of resupplying developer to the developer containing portion of the developer frame;

a developing container reconstructing step of:

stripping off a connecting portion seal member sealing an electrical contact, disposed at a united portion of the developing frame and the developer frame at which the developing frame and the developer frame unite when the developing frame and the developer frame are reunited to reconstruct the developing container, to effect electrical connection astride the developing frame and the developer frame when the developing frame and the developer frame reunite to reconstruct the developing container, so that the developer may not adhere to the electrical contact and thereafter interposing a reseal member on one widthwise end and the other widthwise end of a developer supply opening of the developer containing portion, the developer supply opening being configured and positioned to supply the developer contained in the developer containing portion to the developing roller along a lengthwise direction of the developer supply opening, and reuniting the developing frame and the developer frame to thereby reconstruct the developing container; and a reuniting step of reuniting the reconstructed developing container and the drum unit.

4. A method according to claim 3, wherein said developing container reconstructing step further comprises the step of superposing the reseal member on and interposing the reseal member between end portion seal members provided at one lengthwise end and the other lengthwise end of the developer supply opening.

5. A method according to claim 2 or 3, further comprising the step of interposing the reseal member between the developing frame and the developer frame inside the electrical contact in the widthwise direction of the developing frame.

6. A method according to claim 1 or 3, further comprising the step of sticking the reseal member on the developing frame, whereby the reseal member is interposed between the developing frame and the developer frame.

7. A method according to claim 1 or 3, further comprising the step of sticking the reseal member on the developer frame, whereby the reseal member is interposed between the developing frame and the developer frame.

8. A method according to claim 1 or 3, wherein the reseal member has a sponge-like shape.

9. A method of remanufacturing a developing device for developing an electrostatic latent image formed on an electrophotographic photosensitive drum comprising:

a developing container separating step of separating a developing frame of a developing container of the developing device, configured and positioned to support a developing roller of the developing device, and a developer frame of the developing container, from each other, the developer frame having a developer containing portion containing therein a developer to be used for the development of the electrostatic latent image by the developing roller;

a developer resupplying step of resupplying developer to the developer containing portion of the developer frame; and a developing container reconstructing step of:

superposing a reseal member on end portion seal members provided at one lengthwise end and the other lengthwise end of a developer supply opening of the developer containing portion, the developer supply opening being configured and positioned to supply the developer contained in the developer containing portion to the developing roller, interposing the reseal member on each of one widthwise end and the other widthwise end of the developing supply opening along a lengthwise direction of the developer supply opening, and reuniting the developing frame and the developer frame to thereby reconstruct the developing container.

10. A method according to claim 9, wherein the developing frame and the developer frame include a united portion at which the developer frame and the developing frame are reunited to reconstruct the developing container in said developing container reconstructing step, wherein an electrical contact is disposed at the united portion to effect electrical connection astride the developing frame and the developer frame when the developing frame and the developer frame are united in said developing container reconstructing step, and wherein said developing container reconstructing step further comprises the step of superposing and interposing the reseal member on a connecting portion seal member sealing the electrical contact so that the developer may not adhere to the electrical contact.

11. A method of remanufacturing a developing device for developing an electrostatic latent image formed on an electrophotographic photosensitive drum comprising:

a developing container separating step of separating a developing frame of a developing container of the developing device, configured and positioned to support a developing roller, and a developer frame of the developing container from each other, the developer frame having a developer containing portion containing therein a developer to be used for the development of the electrostatic latent image by the developing roller;

a developer resupplying step of resupplying developer to the developer containing portion of the developer frame; and a developing container reconstructing step of:

stripping off a connecting portion seal member sealing an electrical contact, disposed at a united portion of the developing frame and the developer frame at which the developing frame and the developer frame unite when the developing frame and the developer frame are reunited to reconstruct the developing container, to effect electrical connection astride the developing frame and the developer frame when the developing frame and the developer frame reunite to reconstruct the developing container, so that the developer may not adhere to the electrical contact, and thereafter interposing a reseal member on one widthwise end and the other widthwise end of a developer supply opening of the developer containing portion, the developer supply opening being configured and positioned to supply the developer contained in the developer containing portion to the developing roller along a lengthwise direction of the developer supply opening; and reuniting the developing frame and the developer frame to thereby reconstruct the developing container.

12. A method according to claim 11, wherein said developing container reconstructing step further comprises the step of superposing the reseal member on and interposing the reseal member between end portion seal members provided at one lengthwise end and the other lengthwise end of the developer supply opening.

13. A method according to claim 10 or 11, further comprising the step of interposing the reseal member between the developing frame and the developer frame inside the electrical contact in the widthwise direction of the developing frame.

14. A method according to claim 9 or 11, further comprising the step of sticking the reseal member on the developing frame, whereby the reseal member is interposed between the developing frame and the developer frame.

15. A method according to claim 9 or 11, further comprising the step of sticking the reseal member on the developer frame, whereby the reseal member is interposed between the developing frame and the developer frame.

16. A method according to claim 9 or 11, wherein the reseal member has a sponge-like shape.

17. A method of remanufacturing a process cartridge detachably mountable to an electrophotographic image forming apparatus, the process cartridge having a developer container containing a developer therein, and a developing container having a developing roller configured and positioned to bear on the surface thereof the developer supplied from the developer container and transporting it to a developing position, the developer container and the developing container being united together and being capable of being separated and reunited, wherein the developer container and the developing container include a united portion at which the developer container and the developing container are united when the developer container and the developing container are united, the process cartridge also having end portion seal members configured and positioned to seal the lengthwise opposite end portions of the united portion, a connecting portion astride the united portion of the developing container and the developer container and electrically connected near the united portion, and a connecting portion seal member configured and positioned to seal the connecting portion from the developer, the method comprising the step of:

superposing a reseal member, having substantially the same cross section in the lengthwise direction thereof as the end portion seal members, on the end portion seal members and the connecting portion seal member to thereby seal a reunited portion of the developing container and the developer container at which the developing container and the developer container are reunited when the developing container and the developer container are reunited after being separated.

18. A method according to claim 17, wherein the reseal member has a sponge-like shape.

19. A method according to claim 17, further comprising the step of sealing an inner side portion of the developing container with respect to the connecting portion with the reseal member.

20. A method of remanufacturing a developing device used in an electrophotographic image forming apparatus, the developing device having a developer container containing a developer therein, a developing container having a developing roller configured and positioned to bear on the surface thereof the developer supplied from the developer container and carrying it to a developing position, the developer container and the developing container being united together at a united portion, end portion seal members configured and positioned to seal the opposite lengthwise end portions of the united portion, a connecting portion astride the united portion of the developing container and the developer container and electrically connected near the united portion, and a connecting portion seal member configured and positioned to seal the connecting portion from the developer, said method comprising the step of:

superposing a reseal member, having substantially the same cross section in the lengthwise direction thereof as the end portion seal members, on the end portion seal members and the connecting portion seal member to thereby seal a reunited portion of the developing container and the developer container at which the developing container and the developer container are reunited when the developing container and the developer container are reunited after being separated.

21. A method according to claim 20, wherein the reseal member has a sponge-like shape.

22. A method according to claim 20, further comprising the step of sealing the inner side portion of the developing container with respect to the connecting portion with the reseal member.

23. A method of remanufacturing a developing device used in an electrophotographic image forming apparatus, the developing device having a developing frame configured and positioned to support a developing roller configured and positioned to develop an electrostatic latent image on an electrophotographic photosensitive member, a developer containing frame united with the developing frame at a united portion by welding, an electrical contact disposed near the united portion of the developing frame and the developer containing frame, and an elastic seal member provided between the electrical contact and an opening portion of the developing frame, said method comprising the steps of:

removing the elastic seal member when the developing frame and the developer containing frame are to be reunited after being separated from each other; and thereafter disposing elastic seal members on a lengthwise side portion of the united portion, and on the portion between the electrical contact and the opening portion of the developing frame.

24. A method according to claim 23, wherein the elastic seal members disposed on the lengthwise side portion of the united portion and on the portion between the electrical contact and the opening portion of the developing frame are integral with each other.

25. A method according to claim 23, wherein the elastic seal members are also disposed on the lengthwise end portion of the united portion, and wherein the elastic seal members disposed on the lengthwise end portion of the united portion, the lengthwise side portion of the united portion, and the portion between the electrical contact and the opening portion of the developing frame are integral with one another.

26. A method according to claim 23, further comprising the step of disposing the elastic seal members to surround the electrical contact.

27. A method of remanufacturing a process cartridge used in an electrophotographic image forming apparatus, the process cartridge having an electrophotographic photosensitive member, a developing roller configured and positioned to develop an electrostatic latent image on the electrophotographic photosensitive member, a developing frame configured and positioned to support the developing roller, a developer containing frame united with the developing frame at a united portion by welding, an electrical contact disposed near the united portion of the developing frame and the developer containing frame, and an elastic seal member provided between the electrical contact and an opening portion of the developing frame, said method comprising the steps of:

removing the elastic seal member when the developing frame and the developer containing frame are to be reunited after being separated from each other; and thereafter disposing elastic seal members on a lengthwise side portion of the united portion, and on the portion between the electrical contact and the opening portion of the developing frame.

28. A method according to claim 27, wherein the elastic seal members disposed on the lengthwise side portion of the united portion, and the portion between the electrical contact and the opening portion of the developing frame are integral with each other.

29. A method according to claim 27, wherein the elastic seal members are disposed on the lengthwise end portion of the united portion, and wherein the elastic seal members disposed on the lengthwise end portion of the united portion, the lengthwise side portion of the united portion and the portion between the electrical contact and the opening portion of the developing frame are integral with one another.

30. A method according to claim 27, further comprising the step of disposing the elastic seal members to surround the electrical contact.

* * * * *

UNITED STATES PATENT AND TRADEMARK OFFICE

CERTIFICATE OF CORRECTION

PATENT NO. : 6,735,405 B2
DATED : May 11, 2004
INVENTOR(S) : Akiyoshi Yokoi et al.

It is certified that error appears in the above-identified patent and that said Letters Patent is hereby corrected as shown below:

Column 2,
Line 50, “There” should read -- These --.

Column 7,
Line 27, “clinch 83c, which is” should read -- clinch 83c --.

Column 10,
Line 64, “lengthwisely” should read -- lengthwise --.

Column 11,
Line 45, “afore described” should read -- afore-described --.

Column 16,
Line 50, “united” should read -- reunited --.

Column 17,
Line 3, “and” should be deleted.

Signed and Sealed this

Second Day of November, 2004

JON W. DUDAS
*Director of the United States Patent and Trademark Office*